US009633560B1

(12) United States Patent
Gao et al.

(10) Patent No.: US 9,633,560 B1
(45) Date of Patent: Apr. 25, 2017

(54) TRAFFIC PREDICTION AND CONTROL SYSTEM FOR VEHICLE TRAFFIC FLOWS AT TRAFFIC INTERSECTIONS

(71) Applicants: Jason Hao Gao, Cambridge, MA (US); Chao Gao, Fremont, CA (US)

(72) Inventors: Jason Hao Gao, Cambridge, MA (US); Chao Gao, Fremont, CA (US)

(73) Assignees: Jason Hao Gao, Cambridge, MA (US); Chao Gao, Fremont, CA (US)

( * ) Notice: Subject to any disclaimer, the term of this patent is extended or adjusted under 35 U.S.C. 154(b) by 0 days.

(21) Appl. No.: 15/084,793

(22) Filed: Mar. 30, 2016

(51) Int. Cl.
*G08G 1/081* (2006.01)
*G08G 1/01* (2006.01)
*G08G 1/07* (2006.01)

(52) U.S. Cl.
CPC ..... *G08G 1/0145* (2013.01); *G08G 1/07* (2013.01)

(58) Field of Classification Search
CPC G08G 1/07; G08G 1/054; G08G 1/08; G08G 1/081; G08G 1/0125; G08G 1/0133; G08G 1/0145; G08G 1/042; G08G 1/00
USPC ..... 340/907, 910, 916, 919, 922, 937; 701/117, 118
See application file for complete search history.

(56) References Cited

U.S. PATENT DOCUMENTS 6,111,523 A * 8/2000 Mee ..... G08G 1/054 340/936
6,317,058 B1 * 11/2001 Lemelson ..... G08G 1/07 340/905
8,675,909 B2 * 3/2014 Sivertsen ..... G08G 1/096 340/905
2016/0247401 A1 * 8/2016 Nguyen ..... G08G 1/095

* cited by examiner

*Primary Examiner* — Hung T Nguyen
(74) *Attorney, Agent, or Firm* — JingMing Cai; SAC Attorneys LLP

(57) ABSTRACT

A method and a traffic prediction and control system (TPCS) for predicting and controlling vehicle traffic flow through a traffic intersection dynamically with proximal traffic intersections are provided. The TPCS dynamically receives sensor data from sensors at a local traffic intersection, determines traffic flow parameters, and determines a traffic flow flux using the traffic flow parameters. The TPCS dynamically receives analytical parameters from sensors at proximal traffic intersections and determines a minimum safe driving distance between leading and trailing vehicles, a traffic free flow density, a synchronized traffic flow density, and a traffic jam density to predict transitions of the vehicle traffic flow across traffic flow phases through the local traffic intersection. The TPCS controls the vehicle traffic flow by dynamically adjusting duration of traffic signals of the local traffic intersection and transmitting traffic signal time adjustment instructions to the proximal traffic intersections to maintain an optimized traffic flow flux.

24 Claims, 15 Drawing Sheets

TRAFFIC PREDICTION AND CONTROL SYSTEM FOR VEHICLE TRAFFIC FLOWS AT TRAFFIC INTERSECTIONS

BACKGROUND

Understanding behavior of vehicle traffic flow has been of significant interest to scientists, transportation researchers, transportation engineers, road engineers, urban planners, policy makers, computer scientists, economists, vehicle manufacturers, and commuters who rely on transportation on a daily basis. As used herein, "vehicle traffic flow" refers to movement of vehicles between two points or traffic intersections. Also, as used herein, "traffic intersection" refers to a junction between two or more roads that meet or cross each other. Traffic jam and traffic phase transitions affect people who encounter traffic jams daily on city, urban and highway roads. With the advent of wirelessly connected and autonomous vehicles with vehicle-to-vehicle (V2V) communications and advanced driver assistance systems (ADAS), both behavior and modeling of vehicle traffic flows are deemed to change dramatically. Vehicle traffic flow is typically controlled by traffic signals at traffic intersections using a computer controlled preprogrammed timer sequence. The traffic signals defined, for example, by a green traffic signal light, a yellow traffic signal light, and a red traffic signal light are timed to change their sequence after a predetermined time period to regulate the vehicle traffic flow, for example, by retaining a long duration of the green traffic signal light for long roads with heavy vehicle traffic flow and a short duration of the green traffic signal light for short roads with low vehicle traffic flow. The predetermined time period is set after an extensive examination of vehicle traffic flow patterns at respective traffic intersections. The timing of the traffic signals is varied with the computer controlled preprogrammed timer sequence to regulate vehicle traffic flow during peak hours and scheduled events at the respective traffic intersections. Actions and efforts to improve traffic throughput, that is, an integral of traffic flow flux, via the traffic signals are predetermined and preprogrammed. Conventional traffic signal control systems use inductive loop detectors or video cameras to detect vehicles in a particular direction. When there are no vehicles in any of the directions, the traffic signal lights need to be dynamically changed to red to allow vehicles waiting for green traffic signal lights on other cross directions to pass through. The conventional traffic signal control approach may improve the traffic throughput provided traffic is low, that is, for a vehicle traffic flow with a near-zero flow density, and provided the traffic is asymmetric, that is, when the vehicles wait for red traffic signal lights in a particular direction and there are no vehicles in the cross directions. The conventional traffic signal control approach does not apply to most of the traffic cases where the traffic is congested and needs an optimized vehicle traffic flow control. A congested vehicle traffic flow with a moderate traffic flow density is well defined as the traffic flow speed cannot reach the predefined speed limit for that road.

Traffic signals are typically time dependent and do not cater to real world traffic conditions. For example, the traffic signals typically do not consider traffic influencing factors, for example, human factors, road conditions, vehicle traffic flow at other proximal traffic intersections, etc. Furthermore, the traffic signals typically depend on historic data examined and preprogrammed with a predetermined time at the respective traffic intersections and do not cater to a real time vehicle traffic flow pattern that results from a growing number of vehicles including human driven vehicles and autonomous vehicles on the roads. Individually, drivers of the vehicles spend a significant amount of time at traffic signals waiting for a traffic signal light to turn green, even though there is no actual vehicle traffic flow at traffic intersections in other directions. Furthermore, conventional vehicle traffic flow control methods lack efficient utilization of an unutilized pass-through efficiency for an oncoming direction with an asymmetric left-turn, where a left-turn signal is longer for a heavy traffic direction, and for cross directions by shortening a green traffic signal light duration as long as the shortened duration does not cause accumulation of vehicles for other directions. The un-optimized traffic signal light control results in frustrated drivers and possible further traffic jam, rash driving, and eventual accidents. Collectively, the overall traffic throughputs in all directions of a traffic intersection and proximal traffic intersections are far from optimized while considering symmetric and asymmetric vehicle traffic flows in opposite directions and as well as their upstream and downstream traffic intersections.

Moreover, a longer wait time of the vehicles translates to wasted gasoline and an increase in air pollution. Traffic signals at traffic intersections are configured based on a fundamental diagram of vehicle traffic flow, which is typically used as a standard for designing traffic models in the transport and research industry. The fundamental diagram of vehicle traffic flow is a diagram that provides a relation between the traffic flow flux, that is, vehicles per hour or vehicles per second, and a traffic flow density, that is, vehicles per kilometer (km) or length percentage of vehicles occupying a road lane. Vehicle traffic flows were first studied in 1935 by Greenshield, who based his study on a phenomenological model which assumed a linear traffic flow density-traffic flow speed relation with one fitting parameter, resulting in a quadratic relation between the traffic flow flux and the traffic flow density, since the traffic flow flux is a product of the traffic flow density and the traffic flow speed. The traffic flow flux-traffic flow density curve resulting from an assumed or curve-fitting traffic flow density-traffic flow speed relation is referred to as the fundamental diagram in transportation research and control. Greenshield's model was refined by many others using various traffic flow density-traffic flow speed relations with more modeling parameters. Van Aerde's model significantly improved Greenshield's model from a symmetric fundamental diagram shape to an asymmetric fundamental diagram shape by assuming a non-linear traffic flow density-traffic flow speed with four fitting parameters. In conventional fundamental diagram models, for a given traffic flow density, there is one and only one corresponding traffic flow speed and traffic flow flux, or vice versa.

Starting in the 1950s, fluid-dynamical models with numerical methods were employed to study a phase transition from a laminar flow, that is, a well-ordered state, to start-stop motions, that is, a disordered state, and the resultant density waves with increasing traffic flow density. In these approaches, a density-speed relation is either assumed or numerically fitted. More recently, computer simulations have been applied to the study of vehicle traffic flows. Nagel and Schreckenberg proposed the cellular automaton model using stochastic discrete simulation. The cellular automaton model qualitatively reproduces some macroscopic properties of vehicle traffic flows such as a transition from a smooth motion to start-stop motions. The density wave method was also employed to numerically calculate a shock wave decay in a metastable region in a car-following model.

However, none of the existing models has been able to obtain a theoretical relation for the traffic flow flux-traffic flow density relation, or for a minimum safe driving distance between consecutive vehicles in a vehicle traffic flow. Many other models have realized the importance of human reaction time in vehicle traffic flow behavior, but are still unable to obtain its effect on road capacity.

As disclosed above, the fundamental diagram of vehicle traffic flow was previously empirically derived based on computer simulations, traffic modeling, etc., and does not take into account multiple traffic influencing factors, for example, dry or wet road conditions, drivers' reaction times, etc., which have significant effects on the vehicle traffic flow. In the fundamental diagram of vehicle traffic flow, a traffic flow speed corresponds to one and only one traffic flow density and vice versa. It is incorrect to assume one traffic flow flux corresponds to one traffic flow density or one traffic flow speed, as traffic flow flux may correspond to many traffic flow densities or traffic flow speeds with an upper bound based on experimental observations and computer simulations. Therefore, there is a need for analytically deriving upper boundary flux-density curves instead of modeling and curve-fitting averaged flux-density curves so that phase transitions and traffic jams for vehicles traffic flows can be both qualitatively and quantitatively investigated. Conventional methods used for representing different traffic flow phases and establishing a relation between traffic flow flux and traffic flow density, rely on an empirically derived representation, for example, a triangle peak, etc., with no valid scientific reasoning. These conventional methods do not represent a transition in traffic flow phases without introducing additional modeling parameters and an assumption that road capacity equals the traffic flow flux at the triangle's peak. Furthermore, these conventional methods are not supported with quantitative analysis data to predict transitions across traffic flow phases efficiently.

Conventional methods for analyzing traffic jams have relied upon empirically-derived models and computer simulations. Traffic jams are not only due to crowding of vehicles on the road, but also due to the manifestation of an upper boundary in a traffic flow flux-traffic flow speed plane, from which quantitative conditions and properties, such as critical densities, jam speeds, jam densities, and density waves, for the occurrence of a traffic jam can be rigorously derived. When a traffic jam occurs, the traffic flow speed cannot reach the designated speed limit due to a high traffic flow density, but not necessarily due to a high traffic flow flux, since the traffic flow flux $q=\rho v$, where $\rho$ is the traffic flow density and $v$ is the flow speed. Severely congested traffic may result in a traffic jam, that is, "stop-and-go" traffic behavior. Congested vehicle traffic flows have been investigated both experimentally and via modeling, wave theory, fluid dynamics, and computer simulations. In particular, three traffic flow phases, for example, "free flow," "synchronized flow", and "jam flow" have been experimentally identified and statistically investigated by means of computer simulation. These simulations have qualitatively reproduced experimental observations of the phase transitions by adjusting various model parameters, for example, up to 10 model parameters. However, these simulations could not provide definitive conditions or analytical solutions on these phase transitions, because many model parameters had to be introduced. Furthermore, their use of a triangle with the base of the triangle as the axis of the traffic flow density or an empirically-derived curve to represent the relationship between the traffic flow flux and the traffic flow density defined as the fundamental diagram is born out of a need for convenient representation, without a valid scientific basis. Moreover, road capacity is assumed to be the traffic flow flux at the triangle's peak, where the traffic flow speed is at the traffic free flow speed, which is an inaccurate assumption. There is a need for using the traffic flow density or the traffic flow speed as a variable to maximize the traffic flow flux for vehicle traffic flows.

Predicting vehicle traffic flow at traffic intersections and controlling traffic signals using different factors locally and globally via wireless connections that influence the vehicle traffic flow significantly reduces the amount of vehicle emissions, minimizes the traffic jam, enhances the safety of commuters, and reduces travelling time and waiting time at traffic intersections. To maintain a smooth moving and optimized traffic flow flux at traffic intersections, there is a need for dynamically configuring traffic signals using multiple traffic influencing factors and for an enhanced method that predicts the transitions of vehicle traffic flow across traffic flow phases comprising, for example, a traffic free flow phase, a synchronized traffic flow phase, a jam traffic flow phase, etc., based on quantitatively analyzed traffic influencing factors, and accordingly varies the timing of the traffic signals at their respective traffic intersections.

Hence, there is a long felt but unresolved need for a method and a traffic prediction and control system for predicting and controlling vehicle traffic flow through a traffic intersection dynamically with proximal traffic intersections. Moreover, there is a need for optimizing control of traffic signal lights in real time by utilizing a concerted network method rather than an individually preprogrammed method. Furthermore, there is a need for a centralized traffic monitoring system that takes over functioning of a traffic signal at a traffic intersection that malfunctions due to malfunctioning of computer controlled timers programmed with a predetermined timing sequence. Furthermore, there is a need for generating an analytical fundamental diagram and a traffic phase diagram that predict a traffic flow flux and transitions of traffic flow phases in real time considering both human driven vehicles and wireless autonomous vehicles.

SUMMARY OF THE INVENTION

This summary is provided to introduce a selection of concepts in a simplified form that are further disclosed in the detailed description of the invention. This summary is not intended to determine the scope of the claimed subject matter.

The method and the traffic prediction and control system (TPCS) disclosed herein address the above mentioned need for predicting and controlling vehicle traffic flow through a traffic intersection dynamically with proximal traffic intersections. Moreover, the method and the TPCS disclosed herein optimize control of traffic signal lights in real time by utilizing a concerted network method rather than an individually preprogrammed method. Furthermore, the method and the TPCS disclosed herein address the need for a centralized traffic monitoring system that takes over functioning of a traffic signal at a traffic intersection that malfunctions due to malfunctioning of computer controlled timers programmed with a predetermined timing sequence. Furthermore, the method and the TPCS disclosed herein address the need for generating an analytical fundamental diagram and a traffic phase diagram that predict a traffic flow flux and transitions of traffic flow phases in real time considering both human driven vehicles and wireless autonomous vehicles. The method and the TPCS are applicable to vehicle traffic flows of human driven vehicles and future vehicle traffic flows with and/or without human driven vehicles, for example, autonomous vehicles.

The method disclosed herein employs a traffic prediction and control system (TPCS) comprising at least one processor configured to execute computer program instructions for predicting and controlling vehicle traffic flow through a traffic intersection dynamically with proximal traffic intersections. The TPCS dynamically receives and processes sensor data from one or more sensors, for example, video cameras, laser devices, inductive loop detectors, etc., positioned at a local traffic intersection. The TPCS dynamically determines traffic flow parameters comprising a traffic flow speed, a traffic flow density, and a number of vehicles proximal to the local traffic intersection using the dynamically received and processed sensor data. In the method disclosed herein, the TPCS uses traffic flow density or traffic flow speed as a variable to maximize traffic flow flux for vehicle traffic flows. The TPCS dynamically determines a traffic flow flux using the dynamically determined traffic flow parameters. The TPCS dynamically receives and processes analytical parameters from one or more sensors positioned at one or more proximal traffic intersections via a communication network. The proximal traffic intersections comprise an upstream traffic intersection and a downstream traffic intersection with respect to the local traffic intersection. The TPCS dynamically determines a minimum safe driving distance between a leading vehicle and a trailing vehicle among the vehicles proximal to the local traffic intersection using the dynamically received and processed analytical parameters. The TPCS dynamically determines a traffic free flow density, a synchronized traffic flow density, and a traffic jam density using the dynamically determined minimum safe driving distance, the traffic flow speed, a predefined speed limit, a traffic jam speed, an average length of the vehicles, dry or wet road conditions, and one or more of the dynamically received and processed analytical parameters.

The traffic prediction and control system (TPCS) predicts transitions of the vehicle traffic flow across traffic flow phases through the local traffic intersection using the dynamically determined traffic free flow density, the dynamically determined synchronized traffic flow density, and the dynamically determined traffic jam density. The TPCS controls the vehicle traffic flow through the local traffic intersection by dynamically adjusting duration of traffic signals of the local traffic intersection and transmitting traffic signal time adjustment instructions to each of one or more proximal traffic intersections based on the predicted transitions of the vehicle traffic flow from the local traffic intersection. For controlling the vehicle traffic flow through the local traffic intersection, the TPCS requests the upstream traffic intersection via the communication network to send more or less vehicle traffic flow towards the local traffic intersection to maintain an optimized traffic flow flux based on conditions associated with the traffic flow density and the traffic flow speed. For controlling the vehicle traffic flow through the local traffic intersection, the TPCS also dynamically determines and optimally controls a duration of a green traffic signal light for the vehicles moving in a direction with the dynamically determined traffic flow flux closer to or further away from the optimized traffic flow flux for the traffic flow speed and the traffic flow density at the local traffic intersection by using the dynamically determined traffic flow parameters and by controlling the vehicle traffic flow from the upstream traffic intersection.

The traffic prediction and control system (TPCS) implements an algorithm on vehicle traffic flows that does not require any model parameters, that allows traffic self-organization, and that controls traffic jams. The TPCS is in agreement with real world traffic data on traffic flow phases, jam speeds, road capacity, and an upper envelope of the traffic flow flux-traffic flow density curves associated with the fundamental diagram. The TPCS derives quantitative conditions and critical densities for the occurrence of a synchronized traffic flow and jam traffic, that is, stop-and-go traffic, including jam speeds, jam densities, and density waves. Furthermore, the traffic phase diagram on vehicle traffic flows generated by the TPCS provides a critical traffic flow density for each phase transition and boundary lines separating regions of traffic free flows, synchronized traffic flows, and jam or stop-and-go traffic flows. Given a traffic flow density, the traffic phase diagram predicts the vehicle traffic flow's final state, speed, and traffic flow phase.

In one or more embodiments, related systems comprise circuitry and/or programming for effecting the methods disclosed herein; the circuitry and/or programming can be any combination of hardware, software, and/or firmware configured to effect the methods disclosed herein depending upon design choices of a system designer. Also, various structural elements can be employed depending on the design choices of the system designer.

BRIEF DESCRIPTION OF THE DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and components disclosed herein. The description of a method step or a component referenced by a numeral in a drawing is applicable to the description of that method step or component shown by that same numeral in any subsequent drawing herein.

DETAILED DESCRIPTION OF THE INVENTION

Figure 1A:
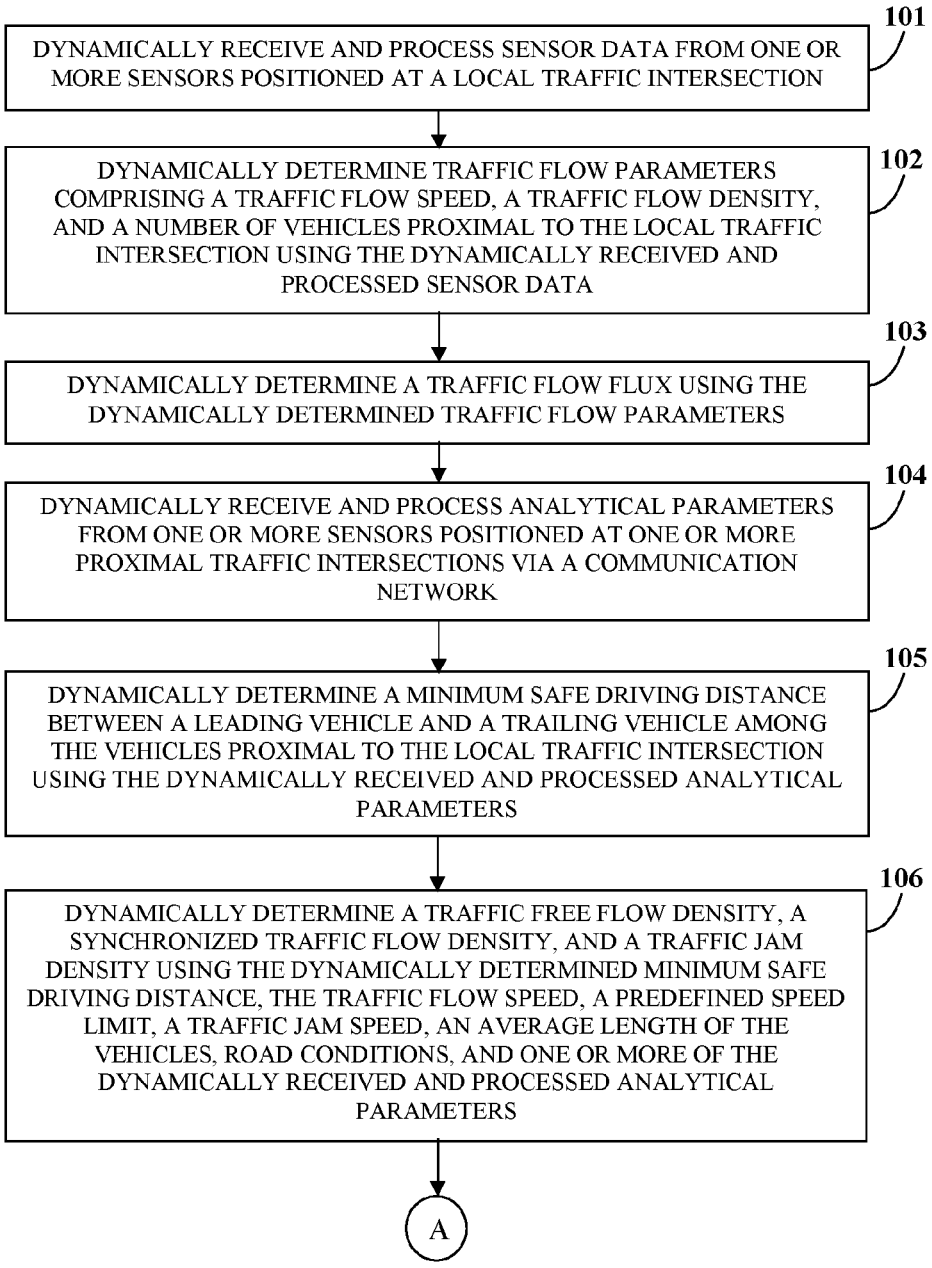
FIGS. 1A-1B illustrate a method for predicting and controlling vehicle traffic flow through a traffic intersection dynamically with proximal traffic intersections.

The method and the traffic prediction and control system (TPCS) disclosed herein implement the following approaches. In a first approach, individual drivers act locally and sequentially towards concerted global actions, resulting in optimized travel efficiency and traffic throughput across a road network. As used herein, "traffic throughput" refers to an integral of traffic flow flux over time. Also, as used herein, "traffic flow flux" refers to a number of vehicles moving towards a traffic intersection per unit time. In a second approach, individual preprogrammed control of traffic signal lights is shifted towards a real time concerted global traffic signal light control in all directions at a traffic intersection and neighboring or proximal traffic intersections, resulting in optimized travel efficiency and traffic throughput across a road network. The first approach requires each traffic intersection and each and every vehicle to possess a wireless communications and control system, which may be difficult to implement in practice as the first approach involves each vehicle, while the second approach requires a central processing unit and sensors that measure traffic flow speed, traffic flow density, and traffic flow flux at each traffic intersection and communications with and between proximal traffic intersections. The second approach utilizes an analytical fundamental diagram represented by traffic flow flux versus traffic flow density or traffic flow speed and a traffic phase diagram represented by transitions from a traffic free flow phase to a synchronized traffic flow phase to a jam traffic flow phase. The jam traffic flow phase is also referred to as a "congested traffic flow phase".

The method disclosed herein focuses on the second approach that does not require installation of a wireless communications and control system on each and every vehicle. Vehicle traffic flows typically comprise, for example, flows of vehicles driven by human drivers, vehicles such as fire trucks, medical emergency vehicles, motorcades, etc., that are in communication with the traffic prediction and control system (TPCS) for a higher priority pass or a continuous pass across traffic intersections. Vehicle traffic flows in the near future will comprise flows of a combination of vehicles driven by human drivers and autonomous vehicles with wireless communications and control systems. Vehicle traffic flows will further comprise flows of autonomous vehicles with communication and control systems. A traffic signal light controls or directs the vehicle traffic flow and not each individual vehicle. The method and the TPCS disclosed herein are applicable for vehicle traffic flows comprising flows of vehicles with or without communication with a communication network. In an embodiment where vehicles operably communicate with the communication network for high priority, the TPCS disclosed herein provides a temporary and one time high priority to the direction with these vehicles to allow these vehicles to pass through a traffic intersection, and then resumes a dynamic and concerted control of the vehicle traffic flow through the traffic intersection dynamically with proximal traffic intersections. In this embodiment, the TPCS assigns a one-time priority pass to classified vehicles, for example, fire trucks, medical emergency vehicles, etc., to allow the classified vehicles to pass through the traffic intersection before resuming normal operations. These classified vehicles are in operable communication with the TPCS over the communication network. The method and the TPCS disclosed herein optimize control of traffic signal lights in real time by utilizing a concerted network method that optimally and dynamically controls traffic signals and vehicle traffic flow at all traffic intersections in a network, rather than utilizing an individually preprogrammed method that controls traffic signals and vehicle traffic flow at each individual traffic intersection without considering other traffic intersections in the network.

Figure 1B:
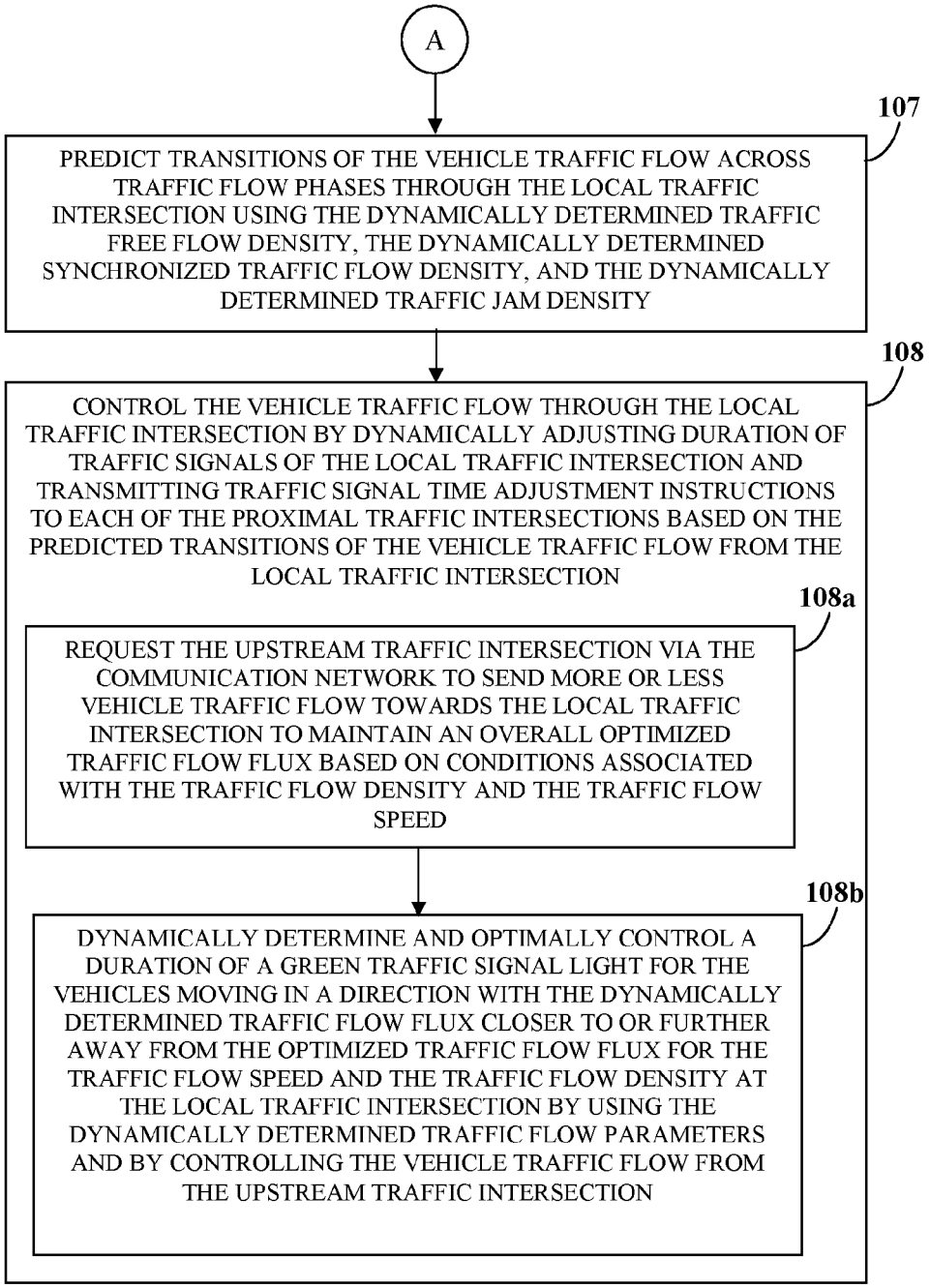

FIGS. 1A-1B illustrate a method for predicting and controlling vehicle traffic flow through a traffic intersection dynamically with proximal traffic intersections. The method disclosed herein employs the traffic prediction and control system (TPCS) comprising at least one processor configured to execute computer program instructions for predicting and controlling vehicle traffic flow through a traffic intersection dynamically with proximal traffic intersections. The TPCS dynamically receives 101 and processes sensor data from one or more sensors positioned at a local traffic intersection. As used herein, "local traffic intersection" refers to a reference point traffic intersection for and through which the TPCS predicts and controls vehicle traffic flow dynamically with proximal traffic intersections. The proximal traffic intersections comprise an upstream traffic intersection and a downstream traffic intersection with respect to the local traffic intersection. As used herein, "upstream traffic intersection" refers to a traffic intersection located in an upstream direction with respect to the local traffic intersection. The upstream traffic intersection directs the vehicle traffic flow towards the local traffic intersection. Also, as used herein, "downstream traffic intersection" refers to a traffic intersection located in a downstream direction with respect to the local traffic intersection. The downstream traffic intersection directs the vehicle traffic flow in the downstream direction away from the local traffic intersection and towards subsequent downstream traffic intersections. The sensors positioned at the local traffic intersection and the proximal traffic intersections comprise, for example, video cameras, laser devices, inductive loop detectors, etc. The sensor data comprises, for example, images of the vehicle traffic flow received from video cameras positioned at the local traffic intersection, distance data received from laser devices that use a LIDAR, also referred to as laser detection and range (LADAR) remote sensing technology that measures distance between vehicles by illuminating each vehicle with a laser and analyzing the reflected light, etc.

The traffic prediction and control system (TPCS) dynamically determines 102 traffic flow parameters comprising, for example, a traffic flow speed, a traffic flow density, and a number of vehicles proximal to the local traffic intersection using the dynamically received and processed sensor data. As used herein, "traffic flow speed" refers to an average speed of vehicles moving towards the local traffic intersection. Also, as used herein, "traffic flow density" refers to an average number of vehicles per unit distance. The TPCS dynamically determines the traffic flow speed, the traffic flow density, and the number of vehicles at a traffic intersection from data received from the sensors, for example, image sensors of a video camera, or laser detection and range (LADAR) sensors, or inductive loop sensors. For example, the sensors detect a position of a vehicle at various times and transmit position information to the TPCS to allow the TPCS to dynamically determine vehicle speed, for example, by a distance-change divided by a time-change. When traffic flow speed is zero, the traffic flow density is referred to as "vehicle density", since there is no traffic flow for zero speed.

The traffic prediction and control system (TPCS) dynamically determines the traffic flow density for a single lane, for example, using the following equation (1):

$$\rho = \frac{1}{L'} = \frac{1}{L_0 + v\Delta t + L} \tag{1}$$

where $L_0$ is the average length of the vehicles in the vehicle traffic flow determined by the sensors, for example, a video camera, LADAR technology, etc., with $\rho_0=1/L_0$ being a bumper-to-bumper density at a standstill; $v\Delta t$ is the distance traveled by a trailing vehicle due to a reaction time of the driver $\Delta t$ before applying a brake, which is, for example, about zero for autonomous vehicles or vehicle-to-vehicle (V2V)-enabled vehicles, and about 0.5 seconds to about 1 second for human drivers; "L" is the minimum stopping distance of the trailing vehicle at a speed v; and L' is the minimum safe driving distance for a maximally packed vehicle traffic flow for the dynamically determined traffic flow speed between two consecutive vehicles as equivalently defined by the safety condition in the Nagel-Schreckenberg stochastic model. In an example, a video camera positioned at the local traffic intersection captures images of the vehicles and transmits the images to the TPCS for processing and determination of the average length of the vehicles, for example, over 20 or 100 vehicles. In an embodiment, for multiple lanes, if the vehicles do not swerve or change lanes during braking, the TPCS multiplies the above determined traffic flow density by the number of lanes. The TPCS dynamically determines 103 a traffic flow flux using the dynamically determined traffic flow parameters. For example, the TPCS calculates the traffic flow flux by multiplying the traffic flow speed by the traffic flow density.

The traffic prediction and control system (TPCS) dynamically receives and processes 104 analytical parameters from one or more sensors positioned at one or more proximal traffic intersections, for example, using the second approach disclosed above via a communication network, for example, a wireless communication network. As used herein, "analytical parameters" refers to traffic influencing factors, for example, an average reaction time of average drivers of the vehicles irrespective of whether a driver is a human driver or whether a vehicle is an autonomous driverless vehicle, an average traffic flow speed of the vehicles, an average vehicle mass, an average friction between the vehicles and a road, an average air drag force of the vehicles, etc. The sensors, for example, video cameras installed at proximal traffic intersections monitor the vehicle traffic flow and send live video and data feeds based on the monitoring to the TPCS via a wireless communication network. In an embodiment, the sensors communicate with the TPCS via a wired communication network. The sensors at each of the traffic intersections measure the traffic flow speed. The TPCS estimates the vehicle mass per vehicle length, for example, using historic statistical data. The TPCS considers the average reaction time of average drivers to be in a range of, for example, about 0.5 seconds to about 1.0 second. In an example, for autonomous vehicle traffic flows, the TPCS considers the average reaction time $\Delta t \approx 0$, and for human drivers, $\Delta t \approx 0.75$ seconds. In an embodiment, the TPCS considers the vehicle traffic flow as a human driven vehicle traffic flow for safety, when the vehicle traffic flow comprises human driven vehicles and autonomous vehicles. The TPCS considers parameter a to be, for example, about 12 meters/second$^2$ for dry road conditions, and parameter a to be, for example, about 3 meters/second$^2$ for wet road conditions. A friction coefficient $\rho$ between each of the vehicles and a road in calculating $a=g[\cos\theta\mu+\sin\theta]$ is, for example, about 1.2 for a dry road and about 0.3 for a wet road, where "g" is a gravitational constant at 9.8 meters/second$^2$. The air drag force of each of the vehicles is computed using the formula: $\frac{1}{2}\rho_{air}C_dAv^2$, where $\rho_{air}$ is the air density ~1 kg/m$^3$, $C_d$ is the drag coefficient ~0.3, and A is the frontal area of the order of 1 m$^2$, depending on vehicle designs. In an embodiment, the TPCS dynamically receives and processes analytical parameters from one or more sensors positioned in each of the vehicles proximal to the local traffic intersection via the communication network for the determination of the minimum safe driving distance between the leading vehicle and the trailing vehicle among the vehicles proximal to the local traffic intersection and for the dynamic determination of the traffic free flow density, the synchronized traffic flow density, and the traffic jam density.

The traffic prediction and control system (TPCS) dynamically determines 105 a minimum safe driving distance between a leading vehicle and a trailing vehicle among the vehicles proximal to the local traffic intersection using the dynamically received and processed analytical parameters. As used herein, "minimum safe driving distance" refers to a minimum distance from the leading vehicle that a trailing vehicle has to maintain to avoid a collision with the leading vehicle. For a given traffic flow speed, a trailing vehicle must maintain a minimum safe driving distance from the leading vehicle that is moving in front of the trailing vehicle. The TPCS analytically derives the minimum safe driving distance that determines the maximum allowable traffic flow density at that traffic flow speed, for example, from the friction between the vehicle and road, the air drag force on the vehicle, and the reaction time of the driver, whether the vehicle is human driven or autonomous. That is, the TPCS utilizes the dynamically determined minimum safe driving distance to dynamically determine the maximum traffic flow density for a given traffic flow speed and reaction time. When the traffic flow density exceeds the dynamically determined maximum traffic flow density at the given traffic flow speed, the drivers of the vehicles must brake to maintain the minimum safe driving distance, which is small for a small traffic flow speed. Thus, given a traffic flow speed, the traffic flow density can range, for example, from about 0 to about a maximum allowable traffic flow density. In another example, given the traffic flow density, the traffic flow speed can range from about 0 to about a maximum allowable traffic flow speed, which differs from the fundamental diagram of vehicle traffic flow, in which the traffic flow speed corresponds to only one traffic flow density and vice versa.

Figure 2:
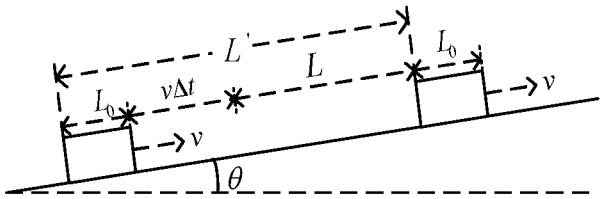
FIG. 2 exemplarily illustrates a schematic diagram showing two consecutive vehicles on a road lane for dynamically determining a minimum safe driving distance between the consecutive vehicles and a maximum traffic flow density.

Consider an example where two consecutive vehicles are moving on a road lane as exemplarily illustrated in FIG. 2. Based on energy conservation during braking, the traffic prediction and control system (TPCS) derives an equation (2) in an integral form for a trailing vehicle travelling at a speed "v" to avoid a physical contact of the trailing vehicle with a rear bumper of the leading vehicle as follows:

$$\int_0^L mg\cos\theta\mu dL + mgL\sin\theta + \int_0^L \frac{1}{2}\rho_{air}C_d A v^2 dL = \frac{1}{2}mv^2 \quad (2)$$

where "L" is the minimum stopping distance of the trailing vehicle at a speed "v"; "m" is the vehicle mass; "g" is the gravitational constant; "μ" is the kinetic friction coefficient; e is positive or negative for uphill driving or downhill driving respectively; $\rho_{air}$ is the air density with a value of, for example, about 1 kg/m$^3$; $C_d$ is the drag coefficient with a value of, for example, about 0.3, and A is the frontal area of the order of, for example, about 1 m$^2$ depending on vehicle designs. The position of the rear bumper of the leading vehicle provides a reference point and covers scenarios such as the leading vehicle falling off a broken bridge or running a red traffic signal light. In this example, the work done by the engine of the vehicle during braking is negligible. The first term in equation (2) above accounts for work done by the friction force. The friction force is considered to be independent of vehicle speed, except at substantially slow speeds, for example, less than 1 meter per second (m/s), in which case boundary lubrication and/or a capillary force affect the friction force. The second term in equation (2) above is the gravity potential. The third term in equation (2) above is the work done by the air drag force. The right-hand side term in equation (2) above is the kinetic energy of the vehicle right before braking.

The traffic prediction and control system (TPCS) integrates the first term in equation (2) above to obtain a constant friction force. To integrate for the third term in equation (2) above, also referred to as a "air drag force term", the TPCS utilizes the following equation (3) of motion for the vehicle under the forces of engine power p(t), friction, and air drag:

$$m\frac{dv}{dt} = \frac{p(t)}{v} - \mathrm{mg}[\cos\theta\mu + \sin\theta] - \frac{1}{2}\rho_{air}C_d A v^2 \quad (3)$$

$$a = g[\cos\theta\mu + \sin\theta] \text{ and } b = \frac{\rho_{air}C_d A}{2m} \quad (4)$$

where in equation (4), "a" is a normalized friction coefficient with a unit of m/s$^2$, and "b" is a normalized air drag coefficient with a unit of 1/m. During the braking process, the engine force p(t)/v is zero, and $dv/dt=-a-bv^2$ from equation (3) and equation (4) above. With dv/dt=(dv/dL)(dL/dt)=v dv/dL, the traffic prediction and control system (TPCS) derives the following equation (5):

$$\int_0^L \frac{1}{2}\rho_{air}C_d A v^2 dL = -mb\int_v^0 v^2\frac{v dv}{a+bv^2} = \frac{mv^2}{2} - \frac{ma}{2b}\ln\left(1+\frac{b}{a}v^2\right) \quad (5)$$

The traffic prediction and control system (TPCS) substitutes equation (4) and equation (5) above into equation (2) disclosed above to dynamically determine the minimum safe driving distance as:

$$L' - L_0 = L + v\Delta t = \frac{1}{2b}\ln\left(1+\frac{b}{a}v^2\right) + v\Delta t \quad (6)$$

The traffic prediction and control system (TPCS) dynamically determines the maximum allowable traffic flow density from equation (1) above for a given traffic flow speed v using the following equation (7):

$$\rho(v) = \frac{2b}{\ln\left(1+\frac{b}{a}v^2\right) + 2bv\Delta t + 2bL_0} \quad (7)$$

The traffic prediction and control system (TPCS) utilizes the inverse of equation (7) to dynamically determine the maximum allowable traffic flow speed v(ρ) for a given traffic flow density. When the maximum allowable traffic flow speed dynamically determined by the TPCS using equation (7) is less than the designated road speed limit, a traffic jam is bound to occur. The traffic flow density is one of a few factors to cause the traffic jam. Therefore, equation (7) quantitatively defines the detailed conditions that result in the traffic jam. For a driver's reaction time of Δt=0, such as for a vehicle traffic flow with wireless communication between vehicles, the TPCS obtains the inverse of equation (7) analytically as $v=\sqrt{a/b}[e^{2bL_0(\rho_0/\rho-1)}-1]^{1/2}$ or a fundamental diagram of $=v\rho=\sqrt{a/b}[e^{2bL_0(\rho_0/\rho-1)}-1]^{1/2}$. The fundamental diagram applies for Δt=0, in the case of vehicle-to-vehicle traffic flow and/or autonomous vehicle traffic flow with wireless communication.

A density-speed relation provided by equation (7) above is different from density-speed relations provided by conventional fundamental diagrams. In the method disclosed herein, only the maximum allowable traffic flow speed is fixed for a given traffic flow density, or conversely, only the maximum allowable traffic flow density is fixed for a given traffic flow speed, which differs from conventional fundamental diagrams, where the traffic flow speed is itself fixed by the density-speed relation for a given traffic flow density, or conversely the traffic flow density itself is fixed for a given traffic flow speed. The TPCS dynamically determines the maximum allowable traffic flow flux $q_m$ using equation (7) above as follows:

$$q_m \equiv \rho * v(\rho) \equiv \rho(v) * v = \frac{2b}{\ln\left(1+\frac{b}{a}v^2\right) + 2bv\Delta t + 2bL_0}v \quad (8)$$

When the traffic flow density exceeds the maximum allowable traffic flow density for a given traffic flow speed or when the traffic flow speed exceeds the maximum allowable traffic flow speed for a given traffic flow density, the vehicles in the vehicle traffic flow are required to brake to maintain or restore the minimum safe driving distance. Equations (6), (7), and (8) above define the basis for vehicle traffic flows in the method disclosed herein, with or without human drivers for any reaction time.

Figure 3A:
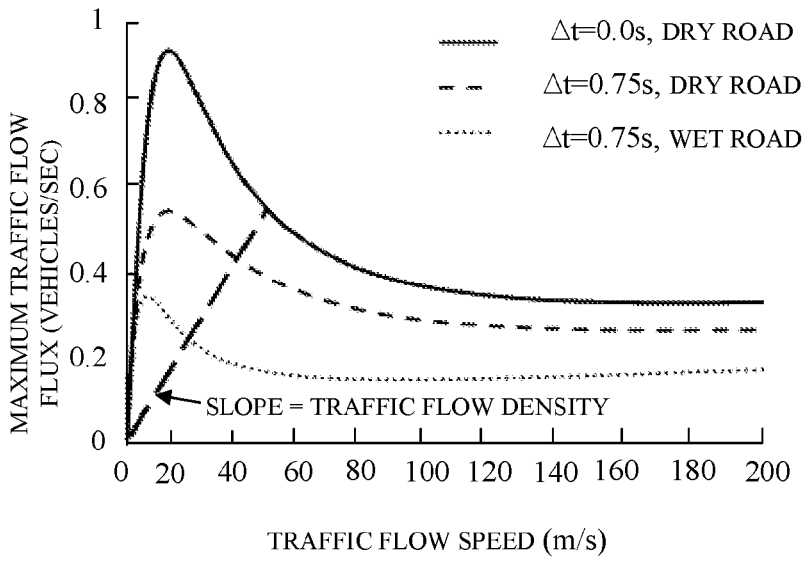
FIGS. 3A-3B exemplarily illustrate graphical representations of maximum traffic flow flux as a function of traffic flow speed.
Figure 3B:
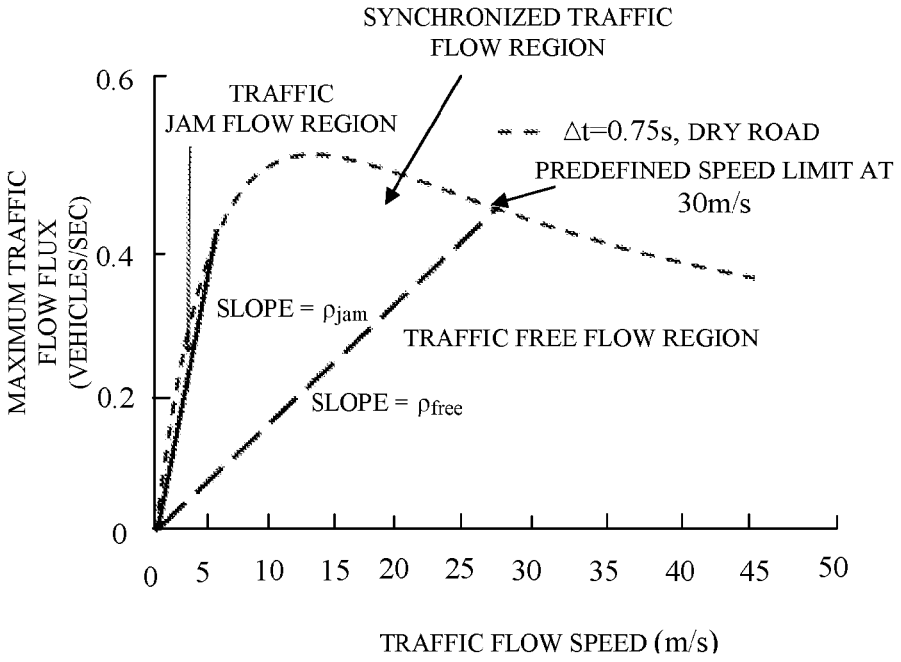

The traffic prediction and control system (TPCS) dynamically determines 106 a traffic free flow density, a synchronized traffic flow density, and a traffic jam density using the dynamically determined minimum safe driving distance, the traffic flow speed, a predefined speed limit, a traffic jam speed using equation (19) disclosed in the detailed description of FIGS. 3A-3B, an average length of the vehicles, road conditions, for example, wet road conditions, dry road conditions, etc., and one or more of the dynamically received and processed analytical parameters. As used herein, "traffic free flow density" refers to a number of vehicles per unit length of a road where the traffic flow speed is equal to or above a predefined speed limit. Also, as used herein, "synchronized traffic flow density" refers to a number of vehicles per unit length of a road, when motion of each trailing vehicle is synchronous with motion of a leading vehicle. Also, as used herein, "traffic jam density" refers to a number of vehicles per unit length of a road during a traffic jam. The TPCS dynamically determines the traffic free flow density denoted by $\rho_{free}$, for example, using equation (9) below:

$$\rho_{free} = \frac{2b}{\ln\left(1 + \frac{b}{a} v_{limit}^2\right) + 2bv_{limit}\Delta t + 2bL_0} \tag{9}$$

where $v_{limit}$ represents the legal speed limit. The TPCS dynamically determines the synchronized traffic flow density using the equation (?). (Please provide the equation for synchronized traffic flow density.) The TPCS dynamically determines the traffic jam density denoted by $\rho_{jam}$, for example, using equation (20) as disclosed in the detailed description of FIGS. 3A-3B.

The above paragraph shall be changed to the following: where $v_{limit}$ represents the legal speed limit, and $\rho_{free}$ the free traffic density. The TPCS also dynamically determines the traffic jam density denoted by $\rho_{jam}$, for example, using equation (20) as disclosed in the detailed description of FIGS. 3A-3B. Hence, the TPCS dynamically can determine the synchronized traffic flow density, which is in between the free traffic density and the jam traffic density.

The traffic prediction and control system (TPCS) predicts 107 transitions of the vehicle traffic flow across traffic flow phases through the local traffic intersection using the dynamically determined traffic free flow density, the dynamically determined synchronized traffic flow density, and the dynamically determined traffic jam density. As used herein, "traffic flow phases" refers to different phases of a vehicle traffic flow. The traffic flow phases comprise, for example, a traffic free flow phase, a synchronized traffic flow phase, and a jam traffic flow phase. As used herein, "traffic free flow phase" refers to a traffic flow phase where the traffic flow speed is at a predefined speed limit to allow free flow of the vehicle traffic. In the traffic free flow phase, the vehicle traffic flow having a small traffic flow density can reach the legal speed limit and beyond the legal speed limit. Also, as used herein, the "synchronized traffic flow phase" refers a traffic flow phase where motion of each trailing vehicle is synchronous with motion of a leading vehicle. In the synchronized traffic flow phase, the speed change of any vehicle affects the trailing vehicle to change speed in accordance with the speed change of the leading vehicle. Also, as used herein, "jam traffic flow phase" refers to a traffic flow phase where the vehicle traffic flow moves with a stop and go motion. In the jam traffic flow phase, the vehicle traffic flow having a large flow density goes through stop-start motions. "Free flow" of the vehicle traffic is characterized as a straight line starting from an axis origin in the fundamental diagram which depicts traffic flow flux versus traffic flow density, where the slope of the straight line is equal to the traffic flow speed, as traffic flow flux is a product of the traffic flow density and the traffic flow speed. In the traffic free flow phase, behaviors of consecutive vehicles may not be correlated or synchronized between consecutive vehicles. For example, when a leading vehicle brakes or accelerates, the trailing vehicle may not follow suit, since the involved vehicles can have different vehicle speeds and distances above the minimum safe driving distance between them.

When the traffic flow density is higher than the largest traffic flow density allowable for vehicle traffic free flows, the vehicle traffic flow may not be able to reach the predefined speed limit while maintaining the minimum safe driving distance between vehicles, thereby resulting in a synchronized traffic flow, where the vehicles travel below the predefined speed limit. In the synchronized traffic flow phase, vehicles must collectively accelerate or decelerate, that is, the deceleration of one vehicle necessitates the deceleration of other vehicles to maintain the minimum safe driving distance between the vehicles. At a substantially low traffic flow density, where the vehicles are far apart, the vehicles can travel at vehicle speeds below the predefined speed limit freely without collective acceleration or deceleration behavior. This vehicle traffic flow is in transition to either a vehicle traffic free flow at the predefined speed limit or to a synchronized traffic flow below the predefined speed limit, depending on a specific traffic flow phase (ρ, v). This is because typical drivers want to minimize travel time, and therefore drive fast until they reach either the predefined speed limit or the maximum allowable traffic flow speed for that traffic flow density as constrained by the minimum safe driving distance between consecutive vehicles for that traffic flow speed. This tendency of drivers to accelerate when possible and safe is the main driving force behind self-organization in traffic flows. The minimum safe driving distance depends on the reaction time of the driver and a vehicle stopping distance, which in turn depends on traffic flow speed, road conditions, for example, dry or wet road conditions, uphill or downhill road conditions, etc., vehicle mass, vehicle friction, air drag force on the vehicle, etc. The minimum safe driving distance at a given traffic flow speed therefore defines the maximum traffic flow density for that given traffic flow speed, and vice versa.

When the vehicle traffic flow is at a further sufficiently high traffic flow density, the vehicle traffic flow may transition to a "jam traffic flow", that is, to a jam traffic flow phase, resulting in a characteristic "stop-and-go" traffic behavior. When the vehicle traffic flow is at a standstill, the traffic flow density is at its maximum, that is, at a bumper-to-bumper density. The traffic prediction and control system (TPCS) predicts the phase transitions from the traffic free flow phase to the synchronized traffic flow phase or the jam traffic flow phase as disclosed in the detailed description of FIGS. 3A-3B.

The traffic prediction and control system (TPCS) controls 108 the vehicle traffic flow through the local traffic intersection by dynamically adjusting duration of traffic signals of the local traffic intersection and transmitting traffic signal time adjustment instructions to each of one or more proximal traffic intersections based on the predicted transitions of the vehicle traffic flow from the local traffic intersection. As used herein, "traffic signal time adjustment instructions" refers to commands that instruct traffic intersections to adjust the duration of their respective traffic signals. For controlling the vehicle traffic flow through the local traffic intersection, the TPCS requests 108*a* the upstream traffic intersection via the communication network to send more or less vehicle traffic flow towards the local traffic intersection to maintain an overall optimized traffic flow flux based on conditions associated with the traffic flow density and the traffic flow speed. For example, for controlling a traffic jam at the local traffic intersection, the TPCS requests the upstream traffic intersection to shorten a duration of a green traffic signal light at the upstream traffic intersection and requests the downstream traffic intersection via the communication network to allow more vehicle traffic flow pass through the downstream traffic intersection to reduce the traffic jam at the local traffic intersection. For controlling blocking of vehicles at a traffic intersection, the TPCS shortens the green traffic signal light at the local traffic intersection to avoid the vehicle traffic flow backup at the local traffic intersection and the TPCS also requests the downstream traffic intersection via the communication network to allow more vehicle traffic flow to pass through the downstream traffic intersection to maintain a jam free phase at the upstream traffic intersection. The conditions for controlling the vehicle traffic flow through the local traffic intersection comprise, for example, the traffic flow density being greater than the dynamically determined traffic free flow density, and the traffic flow density being lesser than the traffic jam density as disclosed in the detailed description of FIGS. 8A-8B. In an embodiment, the conditions for controlling the vehicle traffic flow through the local traffic intersection comprise, for example, the traffic flow speed being less than a predefined percentage of the predefined speed limit, and the traffic flow speed being greater than zero as disclosed in the detailed description of FIGS. 9A-9B.

The traffic prediction and control system (TPCS) dynamically determines and optimally controls 108*b* a duration of a green traffic signal light, for example, to a longer duration or a shorter duration than cross directions and not the oncoming direction, etc., for the vehicles moving in a direction with the dynamically determined traffic flow flux closer to or further away from the optimized traffic flow flux for the traffic flow speed and the traffic flow density at the local traffic intersection in accordance with equation (8) above by using the dynamically determined traffic flow parameters and by controlling the vehicle traffic flow from the upstream traffic intersection. As used herein, "oncoming direction" refers to a direction of vehicle traffic flow moving towards the local traffic intersection from a direction opposite to the direction at issue. For example, if the direction at issue is from south to north, then the directions from north to south is the oncoming direction. Also, as used herein, "cross directions" refers to directions of the vehicle traffic flow moving in a direction perpendicular to the vehicle traffic flow in the oncoming direction or to the direction at issue. For example, if the oncoming direction is from north to south, then the directions from east to west and west to east are the cross directions. The total duration of the green traffic signal light for allowing a left turn, a right turn, and passing through of vehicles for the direction at issue is equal to the total duration of the green traffic signal light for the oncoming direction. However, the duration of the green traffic signal light for allowing vehicles to pass through differs from the duration of the green traffic signal light for the vehicles passing through in the oncoming direction based on the number of left turn waiting vehicles for both directions. For example, if there are no left-turn-waiting vehicles for a direction, the TPCS sets the duration of the left-turn green traffic signal light to zero while activating the green traffic signal light for the left-turn and passing-through vehicles in the oncoming direction. The green light duration for left-turning or for direct passing through vehicle traffic flow is different for the direction at issue and the oncoming direction. The TPCS dynamically determines the duration of traffic signal lights for all directions of the local traffic intersection. The TPCS selects any direction as the direction at issue and dynamically controls the traffic signal lights for all directions for that traffic intersection.

The traffic prediction and control system (TPCS) considers a scenario when the oncoming vehicle traffic flow is less for the direction at issue as an asymmetric case and shortens the duration of the green traffic signal light for a left-turn for the oncoming direction with less vehicle traffic flow to allow more left-turning and passing-through vehicle traffic flow for the direction with heavier traffic. When the vehicle traffic flow is less for the cross directions than that for the direction at issue, the TPCS shortens the duration of the green traffic signal light for the cross directions and increases the duration of the green traffic signal light for the direction with heavier traffic, resulting in a shorter red traffic signal light duration for the direction with heavy traffic which is equal to a shorter green traffic signal light duration for the cross directions. For a typical traffic intersection with two crossing roads, a traffic direction at issue would have one oncoming direction and two cross directions.

Furthermore, the traffic prediction and control system (TPCS) receives and processes traffic flow parameters comprising a traffic flow speed, a traffic flow density, and a number of vehicles proximal to each of one or more proximal traffic intersections, from each of the proximal traffic intersections via the communication network. For controlling the vehicle traffic flow through the local traffic intersection, when possible, the TPCS synchronizes the traffic signals of the local traffic intersection with traffic signals of each of the proximal traffic intersections for an uninterrupted vehicle traffic flow over at least two traffic intersections using the received and processed traffic flow parameters based on a distance condition. In an embodiment, the distance condition comprises a distance between at least two traffic intersections being shorter than a distance traveled by the vehicle traffic flow at a predefined speed limit over the longer time limit $t_{limit}$, that is, a human patience limit, that is, $t_{limit}<L_i/v_{limit}$, where $L_i$ is the distance between the two traffic intersections and $v_{limit}$ is the speed limit between the two traffic intersections. The longer time limit is the sum of the durations of the green, red and yellow traffic signal lights. The TPCS synchronizes the traffic signals of the local traffic intersection with traffic signals of the upstream traffic intersection to allow less vehicle traffic flow to pass through the upstream traffic intersection to avoid accumulation of the vehicle traffic flow at the local traffic intersection based on the traffic flow flux at the upstream traffic intersection being not more than the traffic flow flux at the local traffic intersection and the traffic flow flux at the local traffic intersection being more than half of a calculated maximum traffic flow flux. The TPCS also synchronizes the traffic signals of the local traffic intersection with traffic signals of the downstream traffic intersection to allow more vehicle traffic flow to pass through the local traffic intersection to avoid accumulation of the vehicle traffic flow at the local traffic intersection based on the traffic flow flux between the downstream traffic intersection and a subsequent downstream traffic intersection being lesser than the traffic flow flux at the local traffic intersection.

For a specific control of vehicle traffic flow, the traffic prediction and control system (TPCS) sets the following parameters:

$t_{yellow}$, Yellow traffic signal light duration, for example, 3.8 seconds.

$t_{limit}$, Time limit on a traffic signal light cycle due to human patience consideration, for example, 120 seconds.

The traffic prediction and control system (TPCS) dynamically measures the following parameters:

$q_{in}^{i}$, Average traffic flow flux coming in to the traffic intersection for direction "i" over a one traffic signal light-cycle time.

$q_{out}^{i}$, Average traffic flow flux going out of the traffic intersection for direction "i" over the green traffic signal light duration.

$q_{in}^{i-c}$, the larger of average traffic flow flux coming in to the traffic intersection for cross directions of direction "i" over one traffic signal light-cycle time.

$q_{out}^{i-c}$, the larger of average traffic flow flux straight passing-through out of the traffic intersection for the cross directions of direction "i" over the red traffic signal light duration of direction "i".

The traffic prediction and control system (TPCS) dynamically calculates the following parameters:

$q_{max}^{i}$ the maximum traffic flow flux at the average incoming traffic flow speed for direction "i".

$q_{max}^{i-c}$ the maximum traffic flow flux at the average going-out traffic flow speed for the cross direction.

$$\rho(v) = \frac{2b}{\ln\left(1 + \frac{b}{a}v^2\right) + 2bv\Delta t + 2bL_0}$$

$$q_m \equiv \rho * v(\rho) \equiv \rho(v) * v = \frac{2b}{\ln\left(1 + \frac{b}{a}v^2\right) + 2bv\Delta t + 2bL_0} v$$

with $a \sim 12\frac{m}{s^2}$ for dry road conditions, $a \sim 3\frac{m}{s^2}$ for wet road conditions, $b \sim 0.0015\frac{1}{m}$, $\Delta t \sim 0.75$ seconds and $L_0 \sim 7.5m$.

For any traffic direction "i", at a traffic intersection, the traffic prediction and control system (TPCS) determines the following:

$$q_{out}^{i} = \frac{N_{out}}{t_{green}} = \frac{1}{t_{green}} \int_0^{t_{green}} \rho_{at\ light}(t) v_{at\ light}(t) dt \tag{10}$$

where $q_{out}^{i}$ is the averaged passing-through traffic flow flux during a green traffic signal light, $\rho_{at\ light}(t)$ and $v_{at\ light}(t)$ are measured at the traffic signal light.

$$q_{in}^{i} = \frac{N_{out}}{t_{cycle}} = \frac{1}{t_{cycle}} \int_0^{t_{cycle}} \rho_{far\ from\ light}(t) v_{far\ from\ light}(t) dt) \tag{11}$$

where $q_{in}^{i}$ is the averaged passing-through traffic flow flux during a green traffic signal light, $\rho_{at\ light}(t)$ and $v_{at\ light}(t)$ are measured far from the traffic signal light to avoid stopped vehicles at the red light to affect the measurement results. $t_{cycle}=t_{green}+t_{green,L\text{-}R}^{i}+t_{red}+t_{yellow})$ with $t_{green,L\text{-}R}^{i}$ being the green traffic signal light for a left turn and/or a right turn of the direction "i".

The condition to keep traffic from getting worse for direction "i", on average is given below:

$$q_{in}^{i}(t_{green}+t_{green,L\text{-}R}^{i}+t_{red}+t_{yellow}) \le q_{max}^{i} t_{green} + q_{l\text{-}R}^{i} t_{green,L\text{-}R}^{i} \tag{12}$$

The red traffic signal light for the direction "i" is the green traffic signal light for the cross direction "i-c" and also for a left turn and/or a right turn. The traffic prediction and control system (TPCS) utilizes the following equation for the cross direction i-c:

$$q_{in}^{i-c}(t_{green}+t_{green,L\text{-}R}^{i}+t_{red}+t_{yellow}) \le q_{max}^{i-c}(t_{red} - t_{green,L\text{-}R}^{i-c}) + q_{l\text{-}R}^{i-c} t_{green,L\text{-}R}^{i-c} \tag{13}$$

Since $q_{max}^{i} \gg q_{l\text{-}R}^{i}$, $q_{max}^{i} \gg q_{l\text{-}R}^{i-c}$ and $t_{green} > t_{green,L\text{-}R}$, the TPCS ignores the second term on the right sides of equation (12) and equation (13) above. The TPCS divides the equation (12) by (13) to obtain the following equation (14):

$$t_{green} \ge \frac{q_{in}^{i}}{q_{in}^{i-c}} \frac{q_{max}^{i-c}}{q_{max}^{i}} (t_{red} - t_{green,L-R}^{i-c}) \text{ and } t_{red} \le \frac{q_{in}^{i-c}}{q_{in}^{i}} \frac{q_{max}^{i}}{q_{max}^{i-c}} t_{green} + t_{green,L-R}^{i-c} \tag{14}$$

The TPCS inserts equation (14) into equation (12) to obtain equation (15) below:

$$t_{green} \ge \frac{1}{\frac{q_{max}^{i}}{q_{in}^{i}} - 1 - \frac{q_{in}^{i-c}}{q_{in}^{i}} \frac{q_{max}^{i}}{q_{max}^{i-c}}} (t_{yellow} + t_{green,L-R}^{i} + t_{green,L-R}^{i-c}) \text{ for } t_{cycle} < t_{limit} \tag{15}$$

The equation (15) does not hold for a certain combination of $q_{in}^{i}$, $q_{in}^{i-c}$, $q_{max}^{i}$ and $q_{max}^{i-c}$, which results in the denominator approaching zero or negative for which no time limit can make equation (21) and/or equation (22) held applicable.

The traffic prediction and control system (TPCS) cannot adjust the duration of the traffic signal light cycling length for reducing waiting time, but uses the time limit to cap the traffic signal light cycle duration while adjusting the relative length for the green traffic signal and the red traffic signal light. The vehicle traffic flow may get worse, but the vehicle traffic flow worsening is slower than the worsening of the vehicle traffic flow without the length partition. The TPCS utilizes the pass-through capability of the cross direction with low vehicle traffic flow or allows more vehicles pass at the cross direction with relatively less heavy vehicle traffic flow. When, under the time limit, the equation (12) no longer applies, the traffic signal light cycling time is partitioned by the equation (15) within the preset time limit as follows:

$$t_{cycle}=t_{green}t_{green,L\text{-}R}^{i}+t_{red}+t_{yellow}=t_{limit} \tag{16}$$

The traffic prediction and control system (TPCS) inserts the equation (14) into equation (16), to obtain the following equation:

$$t_{green} + t_{green,L-R}^{i} + \left[\frac{q_{in}^{i-c}}{q_{in}^{i}} \frac{q_{max}^{i}}{q_{max}^{i-c}} t_{green} + t_{green,L-R}^{i-c}\right] + t_{yellow} = t_{limit} \tag{17}$$

or $$t_{green} = \frac{t_{limit} - t_{green,L-R}^{i} - t_{green,L-R}^{i-c} - t_{yellow}}{1 + \frac{q_{in}^{i-c}}{q_{in}^{i}} \frac{q_{max}^{i}}{q_{max}^{i-c}}} t_{red} = t_{limit} - t_{green} - t_{green,L-R}^{i} - t_{yellow} \text{ for } t_{cycle} \ge t_{limit} \tag{18}$$

In the above equation (18), $q_{in}^{i}$ cannot be set to zero which implies no vehicle traffic flow at all for the direction "i", as $q_{in}^{i}$ is in the denominator. However, $q_{in}^{i-c}$ can be set to zero, allowing the vehicle traffic flow to use the direction with zero traffic as the cross direction. If both the direction and its cross directions are without a vehicle traffic flow, the TPCS takes into consideration the crosswalk green traffic signal light. Also, for the direction "i", there are two or more cross directions "i-c". The TPCS utilizes the larger of $q_{in}^{i-c}$ and the corresponding $q_{max}^{i-c}$ from the cross directions.

Consider the following numerical working examples for human driven vehicles with the reaction time set to 0.75 seconds, and for autonomous vehicles with the reaction time set to zero seconds, where the traffic prediction and control system (TPCS) dynamically measures $q_{in}^{i}$, $q_{in}^{i-c}$ $q_{out}^{i}$, and $q_{out}^{i-c}$, and dynamically calculates $q_{max}^{i}$ and $q_{max}^{i-c}$ by utilizing equation (8) disclosed above at the corresponding direction "i" and its cross direction "i-c" with heavier traffic at the measured traffic flow speed. The TPCS utilizes the $t_{limit}$=120 seconds to be set and $t_{yellow}$=3.8 seconds to be set, $t_{green,L-R}^{i}$=10 seconds and $t_{green,L-R}^{i-c}$=10 seconds to be measured for each traffic signal light cycle.

(24

TABLE 1

Optimized traffic signal light durations for human driven vehicles (Δt = 0.75).

| $q_{in}^{i}$ ($s^{-1}$) | $q_{max}^{i}$ ($s^{-1}$) | $q_{in}^{i-c}$ ($s^{-1}$) | $q_{max}^{i-c}$ ($s^{-1}$) | $t_{green}$ (s) | $t_{red}$ (s) | $t_{cycle}$ (s) | Comment ($t_{red}$ includes 10 s for $t_{green,R-L}$ on the cross direction) |
|---|---|---|---|---|---|---|---|
| 0.27 | 0.54 | 0.15 | 0.50 | 59.5 | 45.7 | 119.0 | Eq. (15), within time limit, |
| 0.25 | 0.54 | 0.15 | 0.50 | 46.5 | 40.1 | 100.4 | Eq. (15) |
| 0.20 | 0.54 | 0.15 | 0.50 | 26.7 | 31.7 | 72.2 | Eq. (15) |
| 0.15 | 0.54 | 0.1 | 0.50 | 12.7 | 19.1 | 45.6 | Eq. (15) |
| 0.33 | 0.54 | 0.15 | 0.50 | 163.6 | 90.3 | 267.8 | Eq. (15), exceeding time limit of 120 s |
| 0.33 | 0.54 | 0.15 | 0.50 | 64.5 | 41.7 | 120.0 | applying Eq. (18) |
| 0.35 | 0.54 | 0.15 | 0.50 | 65.8 | 40.4 | 120.0 | Eq. (18) |
| 0.20 | 0.54 | 0.4 | 0.50 | 30.4 | 75.8 | 120.0 | Eq. (18) |
| 0.33 | 0.54 | 0.25 | 0.50 | −130.9 | −97.1 | −214.2 | Eq. (15), exceeding time limit |
| 0.33 | 0.54 | 0.25 | 0.50 | 52.9 | 53.3 | 120.0 | applying Eq. (18) |
| 0.35 | 0.54 | 0.35 | 0.50 | 46.3 | 60.0 | 120.0 | Eq. (18) |
| 0.35 | 0.54 | 0.5 | 0.50 | 37.8 | 68.4 | 120.0 | Eq. (18) |

TABLE 2

Optimized traffic light durations for autonomous vehicles (Δt = 0.0).

| $q_{in}^{i}$ ($s^{-1}$) | $q_{max}^{i}$ ($s^{-1}$) | $q_{in}^{i-c}$ ($s^{-1}$) | $q_{max}^{i-c}$ ($s^{-1}$) | $t_{green}$ (s) | $t_{red}$ (s) | $t_{cycle}$ (s) | Comment ($t_{red}$ includes 10 s for $t_{green,R-L}$ on the cross direction) |
|---|---|---|---|---|---|---|---|
| 0.27 | 0.88 | 0.15 | 0.80 | 14.4 | 18.8 | 47.1 | applying Eq. (15) |
| 0.25 | 0.88 | 0.15 | 0.80 | 12.8 | 18.4 | 45.0 | Eq. (15) |
| 0.20 | 0.88 | 0.15 | 0.80 | 9.2 | 17.6 | 40.7 | Eq. (15) |
| 0.15 | 0.88 | 0.1 | 0.80 | 5.8 | 14.2 | 33.8 | Eq. (15) |
| 0.33 | 0.88 | 0.15 | 0.80 | 20.4 | 20.2 | 54.4 | Eq. (15) |
| 0.33 | 0.88 | 0.15 | 0.80 | 20.4 | 20.2 | 54.4 | Eq. (15) |
| 0.35 | 0.88 | 0.15 | 0.80 | 22.8 | 20.8 | 57.4 | Eq. (15) |
| 0.20 | 0.88 | 0.4 | 0.80 | 19.8 | 53.6 | 87.3 | Eq. (15) |
| 0.33 | 0.88 | 0.25 | 0.80 | 28.6 | 33.8 | 76.2 | applying Eq. (15) |
| 0.33 | 0.88 | 0.25 | 0.80 | 52.5 | 53.7 | 120.0 | applying Eq. (18) |
| 0.35 | 0.88 | 0.35 | 0.80 | 57.4 | 73.2 | 144.4 | Eq. (15), exceeding the time limit |
| 0.35 | 0.88 | 0.35 | 0.80 | 45.8 | 60.4 | 120.0 | applying Eq. (18) |

The green traffic signal light duration $t_{green}$ in Table 1 for human driven vehicles with the reaction time, Δt=0.75 and Table 2 for autonomous vehicles with the reaction time, Δt=0.0 is for vehicle traffic flow passing straight through the green traffic signal light, and the traffic prediction and control system (TPCS) dynamically determines the green traffic signal light for a left turn and a right turn, for example, assumed 10 seconds for Table 1. However, the red traffic signal light duration $t_{red}$ in Table 1 includes the vehicle traffic flow passing straight through the green and left/right turn green for the cross direction. For Table 1, for light traffic and small $q_{in}^{i}$ and $q_{in}^{i-c}$, the TPCS dynamically adjusts the duration for the red traffic signal light and the green traffic signal light to reduce drivers' waiting times on a red traffic signal light. However, for heavy traffic, the TPCS cannot dynamically adjust the duration of the red traffic signal light and the green traffic signal light, since there is not only a time limit on the light cycle time, but also there is a constraint on the applicability of equation (15).

Furthermore, there is a lower time limit on the green traffic signal light duration for pedestrians walking across the crosswalk during the vehicle traffic flow passing straight through the green traffic signal light not including left-turn or right-turn green traffic signal light duration. The traffic prediction and control system (TPCS) handles this situation by adding the required constraint amount to equation (15). If the upper time limit is not long enough due to human patience, the TPCS switches from applying equation (15) to applying equation (18). If equation (18) fails to accommodate the crosswalk time, for a very wide crosswalk with slowly walking pedestrians, then the TPCS adds extra time to the upper time limit, that is, the human patient cap.

FIG. 2 exemplarily illustrates a schematic diagram showing two consecutive vehicles on a road lane for dynamically determining a minimum safe driving distance between the consecutive vehicles and a maximum traffic flow density. Two consecutive vehicles on a road lane are used as a model to dynamically determine the minimum safe driving distance and the maximum traffic flow density for a given traffic flow speed and reaction time of the driver. In FIG. 2, $L_0$ is the average length of the two vehicles, $v\Delta t$ is the distance traveled by the trailing vehicle due to the reaction time of the driver, L is the minimum stopping distance of the trailing vehicle travelling at a speed v, and θ is positive or negative for uphill driving or downhill driving respectively.

FIGS. 3A-3B exemplarily illustrate graphical representations of maximum traffic flow flux as a function of traffic flow speed. As exemplarily illustrated in FIG. 3A, the maximum allowable traffic flow flux from equation (8) disclosed in the detailed description of FIGS. 1A-1B, is plotted against the traffic flow speed for a driver's reaction time of $\Delta t=0$ and for typical wirelessly connected vehicles on a dry road, $\Delta t=0.75$ seconds (s) for typical human drivers driving vehicles on a dry road, and $\Delta t=0.75$ seconds for vehicles on a wet road. When an upper boundary curve in the traffic flow flux-traffic flow speed plane is obtained, the traffic prediction and control system establishes a traffic phase diagram with two phase-transition boundary lines separating the region on and under the maximum traffic flow flux into three traffic flow phase regions of free, synchronized, and jam flows. The upper boundary curve defines the maximum allowable traffic flow flux for a given traffic flow speed or for a given traffic flow density. That is, any traffic flow phase (ρ, v), equivalent to a traffic flow phase (q/v, v), under or on the maximum traffic flow flux versus traffic flow speed curve is allowable, since their corresponding following distances in accordance with equation (6) and equation (7) disclosed in the detailed description of FIGS. 1A-1B, are larger than or equal to the minimum safe driving distance for that traffic flow speed or for that traffic flow density.

As exemplarily illustrated in the FIG. 3A, for the same traffic flow density, the traffic flow speed reaches a maximum value for a zero reaction time of the driver versus a non-zero reaction time of the driver, or for a dry road versus a wet road. Furthermore, FIG. 3A shows that either a longer reaction time of the driver or a wet road condition reduces the traffic flow flux for each traffic flow speed. At high traffic flow speeds greater than or equal to, for example, about 50 m/s for the wet road condition, the traffic flow flux begins to increase as a function of the traffic flow speed. This inflection point manifests at lower traffic flow speeds for the wet road condition than for the dry road condition. In accordance with equation (2) and equation (8) disclosed in the detailed description of FIGS. 1A-1B, the friction force is smaller on wet roads than on dry roads, while the air drag force remains the same, so air drag becomes dominant over friction at a lower speed for wet roads. The traffic prediction and control system (TPCS) dynamically determines the traffic flow flux maxima at the traffic flow flux-traffic flow speed peak, that is, the road capacity for each curve by setting $dq/dv=0$ for equation (8). With $\sqrt{b/a} \ll 1$ allowing the approximation $\ln(1+x^2)\approx x^2$, the TPCS determines the road capacity using $q_{max}\approx 1/(\sqrt{2L_0/a}+\Delta t)$ at $v_{qmax}\approx\sqrt{2aL_0}$, independent of the reaction time of the driver, with $\rho_{qmax}\approx 1/(2L_0+\sqrt{2aL_0}\Delta t)$. For a zero reaction time of the driver, the road capacity $q_{max}\approx\sqrt{a/2L_0}$ occurs at $\rho_0/2$. Thus, a wet road can lower the road capacity significantly, for example, by a factor of ~2.

The traffic prediction and control system (TPCS) dynamically determines a phase transition from a traffic free flow phase to a synchronized traffic flow phase, and also to a jam traffic flow phase as follows: From any point representing a traffic flow phase (q/v, v) on or under the maximum traffic flow flux-traffic flow speed curve exemplarily illustrated in FIG. 3A, a straight line is drawn to the axis origin whose slope is equal to the traffic flow density ρ. The slope of the straight dashed line is equal to the traffic flow density for all traffic flow phases along that straight dashed line. The intersection of the straight line drawn with the maximum traffic flow flux-traffic flow speed curve yields the maximum traffic flow speed that the traffic flow phase will reach, due to the drivers' tendency to accelerate to minimize travel time.

A straight dashed line from the origin is drawn to intersect the maximum traffic flow flux-traffic flow speed curve exemplarily illustrated in FIG. 3B, for example, at $\Delta t=0.75$ seconds and for dry road conditions, at the predefined speed limit. The slope of this synchronized traffic flow to the traffic free flow phase transition boundary line is equal to the traffic flow density $\rho_{free}$ at the phase transition to the traffic free flow. For a reaction time of $\Delta t\approx 0$ versus a non-zero reaction time or for the dry road condition versus the wet road condition, $\rho_{free}$ is larger because the corresponding maximum traffic flow flux-traffic flow speed curve is higher in the traffic flow flux-traffic flow speed plane. For example, the vehicle traffic flow with a substantially low traffic flow density and the traffic flow speed substantially below the predefined speed limit will accelerate to the predefined speed limit and become a traffic free flow. As exemplarily illustrated in FIG. 3B, in the traffic jam flow region, traffic flow density $\rho>\rho_{jam}$, in the synchronized traffic flow region, $\rho_{free},<\rho<\rho_{jam}$, and in the traffic free flow region, $\rho<\rho_{free}$. As exemplarily illustrated in FIG. 3B, each point on or under the traffic flow flux-traffic flow speed curve corresponds to a traffic flow phase (ρ v) with a definitive traffic flow density $\rho=q/v$ and traffic flow speed v. Thus, a traffic flow phase with $\rho<\rho_{free}$ is in, or in transition to, a traffic free flow, since this vehicle traffic flow $\rho<\rho_{free}$, v can reach the predefined speed limit, after the drivers' tendency to accelerate if required.

As exemplarily illustrated in FIGS. 3A-3B, the traffic prediction and control system (TPCS) utilizes the upper boundary or maximum traffic flow flux-traffic flow speed curve, rather than the upper-boundary or maximum traffic flow flux-traffic flow density as in the conventional fundamental diagram or density-speed curves, to investigate the phase transitions for vehicle traffic flows. The TPCS dynamically determines the maximum free-flow density $\rho_{free}$ from equation (9) disclosed in the detailed description of FIGS. 1A-1B, also as shown below:

$$\rho_{free} = \frac{2b}{\ln\left(1+\frac{b}{a}v_{limit}^2\right)+2bv_{limit}\Delta t+2bL_0}$$

where $v_{limit}$ in equation (9) represents the predefined speed limit. FIG. 3A and equation (9) show that a traffic flow phase with the same traffic flow density can be in a traffic free flow phase for the dry road condition, but in a synchronized traffic flow phase or a jam traffic flow phase for the wet road condition.

The traffic prediction and control system (TPCS) dynamically determines the traffic flow phase transition from a synchronized traffic flow phase to a jam traffic flow phase by dynamically determining the traffic jam flow speed $v_{jam}$ below which the traffic jam, "stop-and-go" traffic behavior results. When a decelerating vehicle comes to a stop, the vehicle remains at a standstill for some time referred to as a delay time $t_{del}$ before moving again. The acceleration process is different from the braking process. Thus, the characteristic "stop-and-go" traffic behavior of a traffic jam occurs in a synchronized traffic flow with the traffic flow density $>\rho_{free}$ as obtained from equation (9) above if the braking time of a trailing vehicle following immediately behind a leading vehicle is equal to or less than the delay time of the leading vehicle, since the leading vehicle is still motionless. The TPCS utilizes the equation (6) disclosed in the detailed description of FIGS. 1A-1B, to derive the braking time $t_b$ of the trailing vehicle as a function of the traffic flow speed and set the braking time equal to the delay time to obtain the traffic jam speed $v_{jam}$ as:

$$t_b = \int_0^v \frac{dL}{v} = \frac{1}{a}\int_0^v \frac{dv}{1+\frac{b}{a}v^2} = \frac{1}{\sqrt{ab}}\tan^{-1}\left(\sqrt{\frac{b}{a}}\,v\right), \tag{19}$$

$$\text{that is, } v_{jam} = \sqrt{\frac{a}{b}}\tan\left(\sqrt{ab}\,t_{del}\right)$$

For a delay time of 1.7 seconds, the traffic prediction and control system (TPCS) dynamically determines the corresponding traffic jam speed from equation (19) as $v_{jam}$=20.4 km/h, which is substantially close to the upper bound of the narrow traffic jam speed of 19.5 km/h (1.3 $v_g$) for a dry road condition. As used herein, the "narrow traffic jam speed" refers to speed of the vehicle traffic flow containing a few vehicles involved in a traffic jam. The TPCS considers the delay time to be equivalent to twice the reaction time, for example, 2Δt=1.5 s, because the trailing vehicle needs a reaction time Δt to begin braking after the leading vehicle begins braking, and the leading vehicle needs at least another reaction time Δt to begin moving again after a complete stop, resulting in a minimum time difference of 2Δt between the leading vehicle and the trailing vehicle taking the same action in the braking process. The braking process, for example, deceleration, braking time, and distance of the leading vehicle is the same as that for the trailing vehicle, except that the leading vehicle started the braking process earlier by Δt, and the vehicle has stopped for at least another Δt before the trailing vehicle finishes the braking process to come to a traffic jam stop or a standstill. For a delay time of, for example, 1.5 seconds, the TPCS dynamically determines the corresponding traffic jam speed from equation (19) above as $v_{jam}$=18.0 km/h, which is also close to the upper bound of the narrow traffic jam speed of 19.5 km/h. A rainy day is bad, in all regards, for vehicle traffic flows: in comparison to a dry road, a wet road's $v_{jam}$ in accordance with equation (19) is smaller due to a smaller value of "a", and therefore a traffic jam can occur at lower traffic flow speeds. Consequently, the road capacity, that is, the peak value of the maximum traffic flow flux-traffic flow speed curve at $v_{qmax}$ is also lower and the vehicle traffic flow enters the synchronized traffic flow phase or the jam traffic flow phase at a lower traffic flow density in accordance with equation (9) above.

When the braking time is greater than the delay time, that is, $t_b>t_{del}$, even if a leading vehicle comes to a complete stop, the vehicle traffic flow behind the leading vehicle will slow down, but not to a traffic jam stop or a complete stop as the leading vehicle will already be moving again as the trailing vehicle approaches the leading vehicle. This condition generates the traffic flow density wave upstream along the vehicle traffic flow against the direction of the vehicle traffic flow, if the vehicle traffic flow has been in the synchronized traffic flow phase rather than in the traffic free flow phase.

The traffic prediction and control system dynamically determines the minimum traffic jam density $\rho_{jam}$ using equation (7) disclosed in the detailed description of FIGS. 1A-1B, and equation (19) disclosed above as:

$$\rho_{jam} = \frac{2b}{\ln\left(1+\frac{b}{a}v_{jam}^2\right) + 2bv_{jam}\Delta t + 2bL_0} \tag{20}$$

To obtain the transition from the synchronized traffic flow phase to a jam traffic flow phase, the traffic prediction and control system (TPCS) obtains the traffic flow speed $v_{jam}$ below which "stop-and-go" traffic behavior results. When the traffic flow speed is relatively high, a driver considers both speed and distance from the leading vehicle to actively maintain a safe following distance. When the traffic flow speed is low, that is, <~10 miles/h=16.7 km/h, a typical speedometer is not of much use, so the drivers now can consider only the distance from the leading vehicle, and maintain a low-speed-independent safety margin, $L_{jam}$, from the leading vehicle to avoid tailgating or possibly colliding with the leading vehicle when braking. When the vehicle in the traffic flow takes a braking action, the trailing vehicle in the synchronized traffic flow phase also takes a braking action after the reaction time Δt. It takes a braking-to-stop time $t_b$ for the leading vehicle or the trailing vehicle to brake from a speed v to a stop, which can be obtained from equation (19) (Should this be equation (10)? Yes, you are right, it should be equation (10), but now equation (19) after re-numbering) disclosed in the detailed description of FIGS. 1A-1B, as:

$$t_b = \int_v^0 \frac{-dL}{v} = \frac{1}{a}\int_0^v \frac{dv}{1+\frac{b}{a}v^2} = \frac{1}{\sqrt{ab}}\tan^{-1}\left(\sqrt{\frac{b}{a}}\,v\right), \tag{21}$$

$$\text{or } v = \sqrt{\frac{a}{b}}\tan\left(\sqrt{ab}\,t_b\right)$$

When the braking-to-stop time $t_b$ of the trailing vehicle is shorter than the stopped time $t_s$ of the leading vehicle, the trailing vehicle comes to a stop, continued by the trailing vehicles one by one at a time interval of Δt, resulting in a traffic jam stop, since the leading vehicle has not moved away from the stop. When $t_b>t_s$, the leading vehicle had moved away from the stop before the trailing vehicle comes to a stop; the trailing vehicle can then abort the braking, along with the other trailing vehicles one by one at a time interval of Δt, resulting in no traffic jam stop. If the local traffic flow speed had dropped noticeably due to the braking but without going through a traffic jam stop, this would generate a density wave propagating along the vehicle traffic flow upstream at a traffic flow speed of $$v_{dw} = \frac{1}{\rho\Delta t} - v > L_0/\Delta t,$$

where lip is the average distance between the two involved consecutive vehicles. From equations (1) and (6), $$v_{dw} = \frac{L + L_0}{\Delta t} = \frac{1}{\rho \Delta t} - v = \frac{1}{2b\Delta t}\ln\left(1 + \frac{b}{a}v^2\right) + \frac{L_0}{\Delta t} > \frac{L_0}{\Delta t} \quad (22)$$

A trailing vehicle to brake or abort braking requires Δt and a distance of vΔt after the leading vehicle brakes or aborts braking. Thus, when the following distance between any two vehicles is less than the low-speed-independent safety margin $L_{jam}$ due to local fluctuations in traffic flow density or the vehicle braking due to road hazards or perturbations from vehicles merging into the road lane, corresponding to a local density at $$\rho_{jam} = \frac{1}{L_0 + L_{jam}},$$

the trailing vehicle brakes to avoid tailgating or collision and its trailing vehicle will also brake after Δt. If the braking-to-stop time is less than the stopped time of the leading vehicle, the traffic jam stop occurs. Therefore, the traffic prediction and control system (TPCS) determines the traffic jam speed at which a traffic jam occurs from a quadratic equation by substituting $$\rho_{jam} = \frac{1}{L_0 + L_{jam}}$$

into equation (7) and noting that $$\ln\left(1 + \frac{b}{a}v^2\right) \approx \frac{b}{a}v^2$$

as speed $v \ll \sqrt{a/b}$ ~90 m/s for a dry road condition or $v \ll \sqrt{a/b}$~45 m/s for a wet road condition:

$$v_{jam} \approx a\left[\sqrt{\Delta t^2 + \frac{2L_{jam}}{a}} - \Delta t\right] \quad (23)$$

Assuming the low-speed-independent safety margin $L_{jam}$ is half of the average vehicle length of $L_0/2$, the traffic prediction and control system (TPCS) obtains from equation (23) that $v_{jam}$=4.1 m/s=14.8 km/h for a dry road condition and 3.0 m/s=10.8 km/h for a wet road condition at a reaction time of 0.75 s as listed in Table 3 below with other conditions. At the traffic jam stop, the distance between two consecutive vehicles is thus equal to $L_{jam}-v_{jam}*\Delta t$=0.7 m for a dry road condition or $L_{jam}-v_{jam}*\Delta t$=1.7 m for a wet road condition. $v_{jam}$ was observed at about 15 km/h using loop detectors and computer simulations. The observed traffic jam speed is substantially close to the $v_{jam}$ value for the dry road condition and not far from the wet road condition either for a reaction time of 0.75 second, where a typical human driver reaction time is ~0.5-1 second. For autonomous vehicle traffic flows where Δt≈0, the traffic jam speed is significantly higher than that for human driven vehicle traffic flows, as exemplarily illustrated in Table 3 below. From equation (21), for $v_{jam}$=4.1 m/s for the dry road condition and $v_{jam}$=3.0 m/s for a wet road condition and a reaction time of 0.75 s, the braking-to-stop time is 0.34 s for the dry road condition and 1.0 s for the wet road condition, all less than the observed delay time of 1.7 s for human driven vehicle traffic flows. The delay time is defined as an average waiting time for a vehicle to start to move away from the traffic jam stop after the leading vehicle has moved away from the traffic jam stop, equivalent to the average stopped time. There is no data on the delay time or stopped time for autonomous vehicle traffic flows. Regardless of human-driven vehicles or autonomous vehicles, the braking-to-stop time being significantly longer for a wet road condition suggests that the vehicle traffic flow on rainy days are more likely to form traffic flow density waves than the vehicle traffic flow on sunny days.

For the low-speed-independent safety distance of $L_0/2$, the traffic jam speed $v_{jam}$ in units of m/s and km/h is listed in Table 3 below, for selected values of a road condition of "a" and a reaction time of Δt for $L_0$=7.5 m. a=12 m/s$^2$ corresponds to a dry road condition while a=3 m/s$^2$ corresponds to a wet road condition. Δt=0 for wirelessly connected vehicle traffic flows with or without human drivers. Braking-to-stop time $t_b$ in units of seconds is also listed in Table 3 below.

TABLE 3

| a (m/s$^2$) | Δt (s) | $v_{jam}$ (m/s) | $v_{jam}$ (km/h) | $t_b$ (s) |
|---|---|---|---|---|
| 12 (Dry Road) | 0 | 9.5 | 34.2 | 0.79 |
| 12 | 0.75 | 4.1 | 14.8 | 0.34 |
| 12 | 1.5 | 2.3 | 8.4 | 0.19 |
| 3 (Wet Road) | 0 | 4.7 | 17.1 | 1.58 |
| 3 | 0.75 | 3.0 | 10.8 | 1.0 |

The traffic prediction and control system (TPCS) determines the minimum traffic jam-traffic flow density $\rho_{jam}$ using equation (7) disclosed in the detailed description of FIGS. 1A-1B, and shown as equation (20) above:

$$\rho_{jam} = \frac{2b}{\ln\left(1 + \frac{b}{a}v_{jam}^2\right) + 2bv_{jam}\Delta t + 2bL_0}$$

Figure 4A:
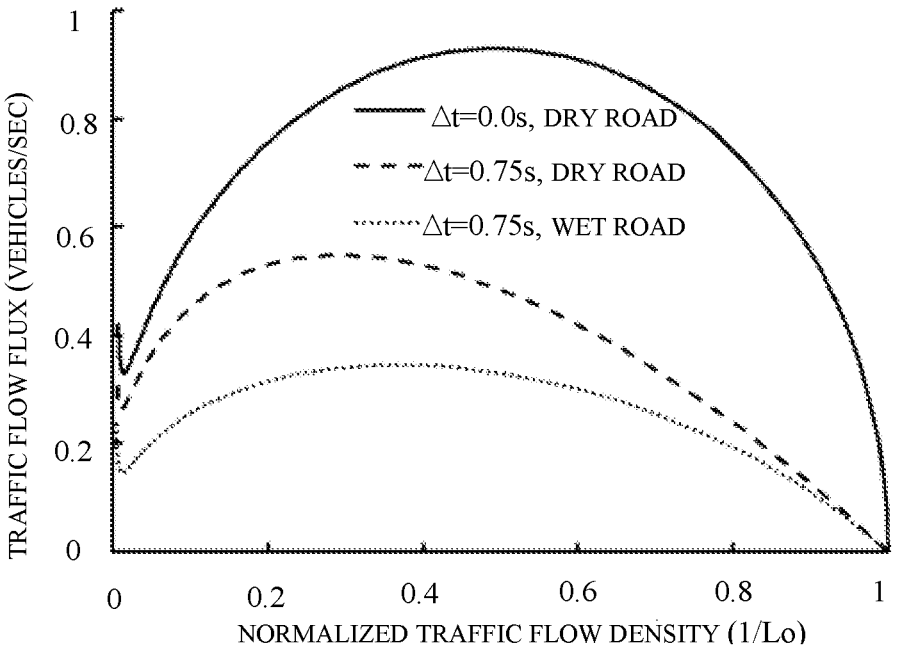
FIGS. 4A-4B exemplarily illustrate graphical representations of maximum traffic flow flux as a function of traffic flow density.
Figure 4B:
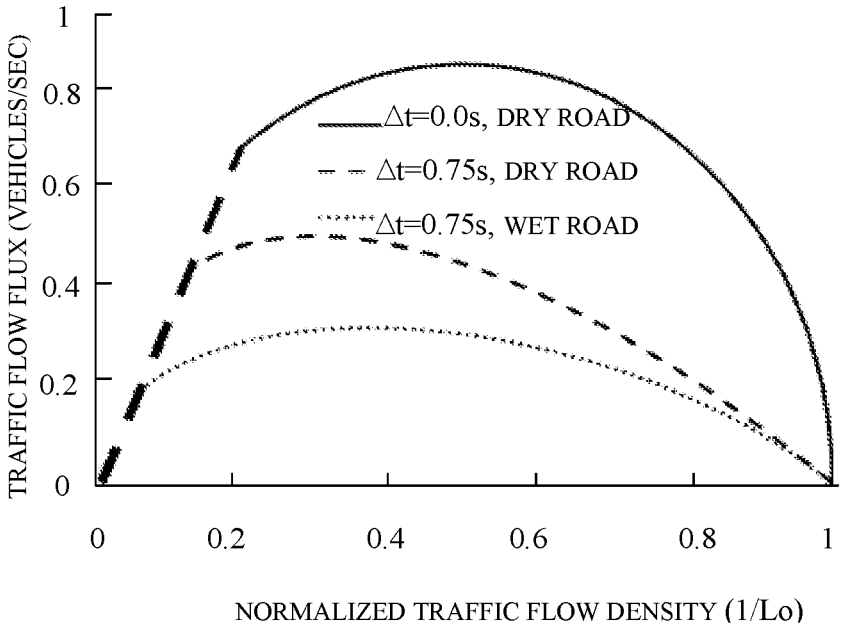

FIGS. 4A-4B exemplarily illustrate graphical representations of maximum traffic flow flux as a function of traffic flow density. FIGS. 4A-4B are used to examine the relationship between the traffic flow flux and the traffic flow density of the fundamental diagram. FIG. 4A exemplarily illustrates the maximum allowable traffic flow flux as a function of normalized traffic flow density in units of $1/L_0$ for wet and dry road conditions at three different reaction times of a driver. As exemplarily illustrated in FIG. 4A the maximum traffic flow flux from equation (8) disclosed in the detailed description of FIGS. 1A-1B, is plotted against the traffic flow density for dry and wet road conditions corresponding to kinetic frictions of 1.2 and 0.3 for rubber tires on a dry pavement and a wet pavement for reaction times of 0 and 0.75 seconds respectively. For small traffic flow densities and thus large traffic flow speeds, the increase of the traffic flow flux as exemplarily illustrated in FIG. 4A, with a decreasing traffic flow density and thus an increasing traffic flow speed is in agreement with the observation in FIG. 3A and as disclosed in the detailed description of FIG.

3A, and is due to the air drag force becoming the dominant force instead of friction, for large traffic flow speeds. Any traffic flow phase with a traffic flow flux and a traffic flow density on or under a theoretical traffic flow flux-traffic flow density is allowable in accordance with equation (8). For example, for a given traffic flow density, a traffic flow phase with a traffic flow flux lower than the maximum traffic flow flux at that traffic flow density and thus under the traffic flow flux-traffic flow density curve implies that the vehicle traffic flow is traveling at a lower traffic flow speed than the maximum allowable traffic flow speed. The traffic flow flux-traffic flow density curve exemplarily illustrated in FIG. 4A, does not define a one-to-one relation between the traffic flow flux and traffic flow density, as the conventional fundamental diagram does, but instead defines an upper bound for every allowed traffic flow phase.

To incorporate the effect of a predefined speed limit into the traffic flow flux curves in FIG. 4A and facilitate a comparison to real world traffic data, the traffic prediction and control system (TPCS) utilizes equation (7) disclosed in the detailed description of FIGS. 1A-1B, to determine the traffic flow density that corresponds to the predefined speed limit of, for example, 109 kilometers per hour (km/h) or 65 miles per hour (mph) for each traffic flow flux-traffic flow density curve, and from the corresponding point on each traffic flow flux-traffic flow density curve, a dashed straight line is drawn to the origin as exemplarily illustrated in FIG. 4B. The dashed straight line replaces the portion of the traffic flow flux curve below the corresponding traffic flow density, and the slope of the dashed straight line is equal to the predefined speed limit. The traffic flow flux-traffic flow density curve of the conventional fundamental diagram is compared to the region under the traffic flow flux-traffic flow density dashed curve in FIG. 4B, for a reaction time of 0.75 seconds and a dry road condition and is found to be in good agreement.

The traffic flow flux at a peak of the traffic flow flux-traffic flow density curve is typically defined as the road capacity, which is the maximum traffic flow flux at for the road. As exemplarily illustrated in FIG. 4B, the road capacity increases by a factor of about 2 for dry roads than for wet roads at a reaction time of 0.75 seconds, or for vehicle traffic flows of wirelessly connected or autonomous vehicles that have about a zero reaction time, that is, $\Delta t=0$, versus human drivers with a 0.75-second reaction time. As exemplarily illustrated in FIG. 4B, the road capacity occurs at the maximum of the traffic flow flux-traffic flow density curves, but the traffic flow speeds at the maximum traffic flow fluxes are lower than the traffic free flow speed and depends, for example, on the road conditions, reaction time of the driver, and air drag force. This allows the use of the traffic flow speed as a control mechanism to maximize road capacity for vehicle traffic flows. As exemplarily illustrated in FIGS. 4A-4B, the dashed-line curves without any fitting parameter resemble the shape of the upper envelope of real traffic data, and is also in agreement with the maximum traffic flow flux or road capacity of the real traffic data.

Figure 5:
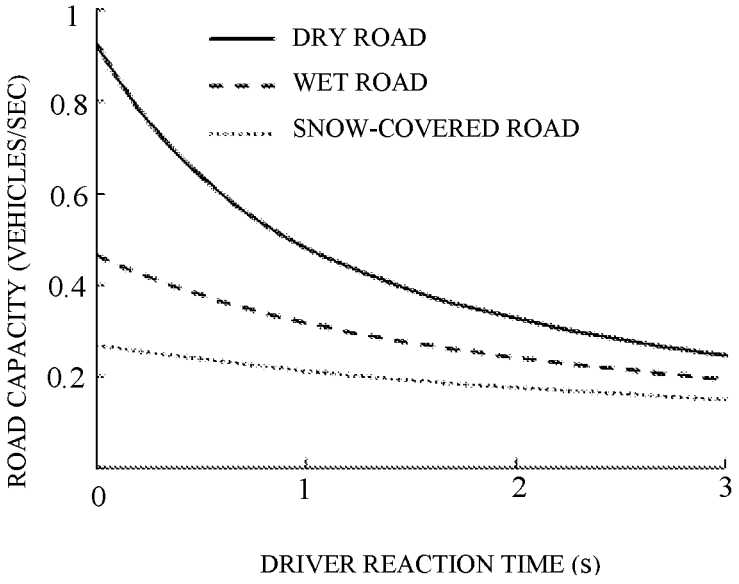
FIG. 5 exemplarily illustrates a graphical representation of road capacity as a function of reaction times of drivers for dry road conditions, wet road conditions, and snow-covered road conditions.

FIG. 5 exemplarily illustrates a graphical representation of road capacity as a function of reaction times of drivers for dry road conditions, wet road conditions, and snow-covered road conditions. As exemplarily illustrated in FIG. 5, the road capacity or the number of vehicles per second, that is, the maximum allowable traffic flow flux from equation (8) disclosed in the detailed description of FIGS. 1A-1B, at the traffic flow flux maxima, is plotted against reaction time of the driver for dry road conditions, wet road conditions, and snow-covered road conditions, where "a" is about 12.0 $m/s^2$, 3.0 $m/s^2$, and 1.0 $m/s^2$ for dry road surfaces, wet road surfaces, and snow-covered road surfaces respectively, corresponding approximately to kinetic friction coefficients of 1.2, 0.3, and 0.1 for rubber tires on dry roads, wet roads, and snow-covered roads, respectively. Average reaction time of the driver is typically 1 second or more for unanticipated stimuli. For example, the estimated reaction time of the driver varies, for example, from about 0.4 seconds to about 2.7 seconds with a mean value of 1.0 second. The driver's age, skill, and driving culture, for example, aggressive versus relaxed, influence the reaction time of the driver. The relation of reaction time of the driver to road capacity results in the following finding: eliminating the human driver reaction time of merely 1 second is equivalent to doubling existing road infrastructure, potentially eliminating the need for infrastructure expansion for some time in some places and when the traffic flow flux is near the road capacity of a given road, traffic jams and start-stop motion results.

Figure 6:
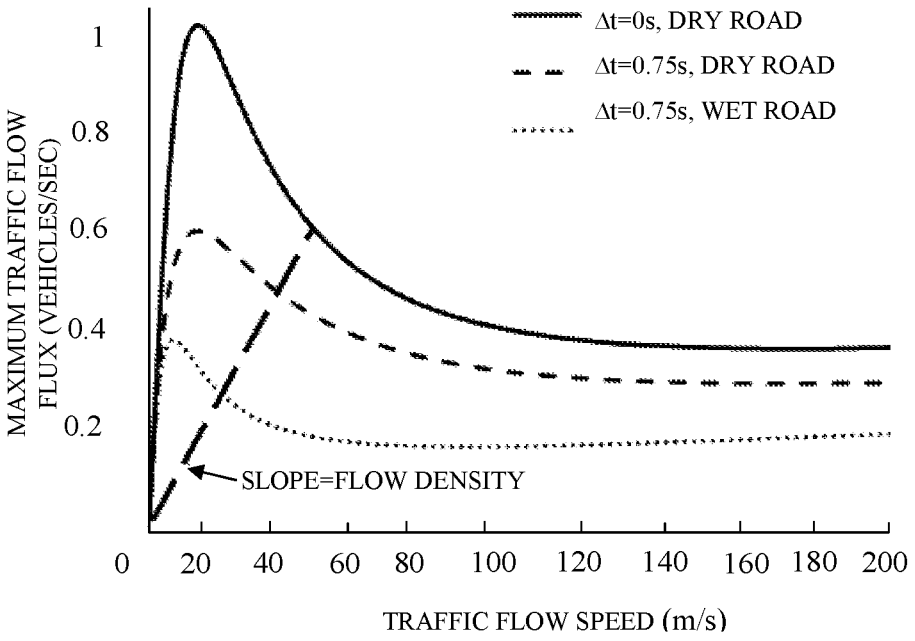
FIG. 6 exemplarily illustrates a graphical representation of maximum allowable traffic flow flux as a function of traffic flow speed.

FIG. 6 exemplarily illustrates a graphical representation of maximum allowable traffic flow flux as a function of traffic flow speed. FIG. 6 exemplarily illustrates maximum traffic flow flux as a function of traffic flow speeds, for example, 50 m/s=180 km/h, from equation (8) disclosed in the detailed description of FIGS. 1A-1B. In FIG. 6, the maximum traffic flow flux from equation (8) is plotted against traffic flow speed for dry road conditions and wet road conditions for reaction times of $\Delta t=0$ and 0.75 seconds. The slope of the straight dashed line exemplarily illustrated in FIG. 6, is equal to the traffic flow density for all traffic flow phases along that line. As exemplarily illustrated in FIG. 6, for a zero reaction time versus a non-zero reaction time, or for a dry road versus a wet road at the same traffic flow density, the traffic flow speed increases to a higher value, and as also exemplarily illustrated in FIG. 3A that either a longer reaction time or a wet road condition reduces the traffic flow flux for every traffic flow speed. At high traffic flow speeds, for example, >~50 m/s for the wet road condition, the traffic flow flux begins to increase as a function of traffic flow speed. The inflection point manifests at lower traffic flow speeds for the wet road condition than for the dry road condition in accordance with equation (2) and equation (8), the friction force is smaller on wet roads than on dry roads, while the air drag force remains the same, so air drag becomes dominant over friction at a lower speed for wet roads. The maximum traffic flow flux at the traffic flow flux-traffic flow speed peak of road capacity for each curve can be obtained by setting $dq/dv=0$ for equation (8). With $\sqrt{b/a} \ll 1$ allowing an approximation $\ln(1+x^2)\approx x^2$, the traffic prediction and control system (TPCS) obtains the road capacity $q_{max}\approx 1/(\sqrt{2L_0/a}+\Delta t)$ at $v_{qmax}\approx\sqrt{2aL_0}$, independent of reaction time, with $\tau_{qmax}\approx 1/(2L_0+\sqrt{2aL_0}\Delta t)$. For a zero reaction time as in the case of autonomous vehicle traffic flow, the road capacity $q_{max}\approx\sqrt{a/2L_0}$ occurs at $\rho_0/2$. Thus, a wet road can lower the road capacity significantly, by a factor of ~2.

As exemplarily illustrated in FIG. 6, a traffic flow phase ($\rho$, v) under the maximum traffic flow flux-traffic flow speed curve can stay at the same traffic flow speed, by increasing its traffic flow flux vertically from increasing its traffic flow density for maximized traffic flow flux or remain at the same traffic flow flux by increasing its traffic flow speed horizontally assuming there is no predefined speed limit or traffic signal light to prevent the traffic flow speed increase, for example, while reducing the traffic flow density as per $q=\rho v$ for least travel time and largest speed. For human drivers, the natural tendency is to act for the least travel time.

However, for autonomous and vehicle-to-vehicle (V2V)-enabled vehicles, precisely combining the vertical and horizontal adjustments as exemplarily illustrated in FIG. 6, can optimize traffic flow flux and global travel-time efficiency across a road network. In the case of a traffic flow speed decrease, for example, due to a lower predefined speed limit, as exemplarily illustrated in the FIG. 6, the speed at the left end of the horizontal line represents the smallest speed the vehicle traffic flow can reach without getting into a stop. In the case of a speed increase, for example, a higher speed limit, as exemplarily illustrated in the FIG. 6, the right end of the horizontal line represents the largest speed the vehicle traffic flow can reach. A traffic flow flux can go above the horizontal line, but the vehicle traffic flow would not be able to get to the smallest or the largest traffic flow speed. The vehicle traffic flow cannot go below the horizontal line or the vehicle traffic flow builds up.

Figure 7A:
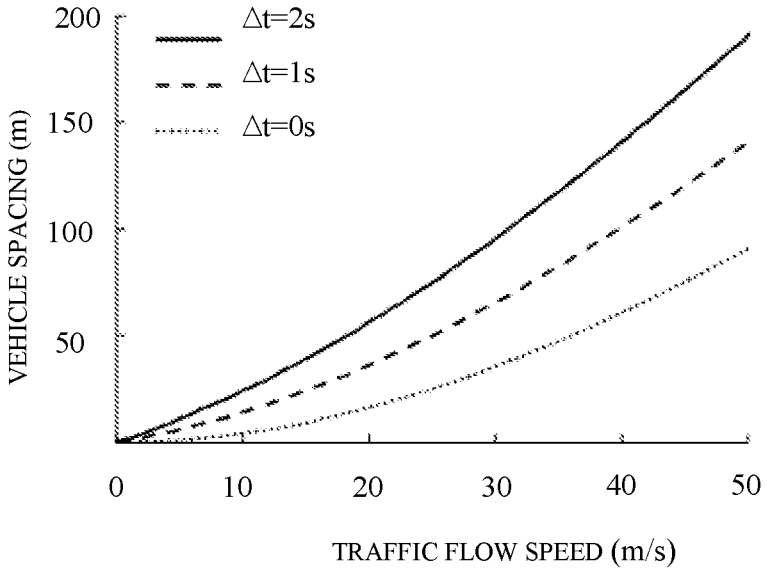
FIGS. 7A-7B exemplarily illustrate graphical representations of vehicle spacing as a function of traffic flow speed and reaction times of drivers.
Figure 7B:
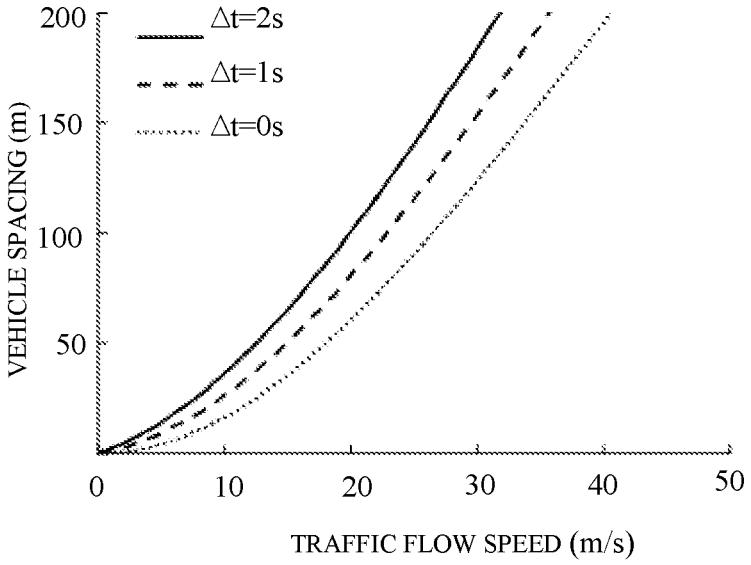

FIGS. 7A-7B exemplarily illustrate graphical representations of vehicle spacing as a function of traffic flow speed and reaction times of drivers. FIGS. 7A-7B exemplarily illustrate vehicle spacing quantitatively as a function of traffic flow speed with a maximum of 50 m/s=180 km/h and reaction time of the driver from equation (6) disclosed in the detailed description of FIGS. 1A-1B. FIGS. 7A-7B exemplarily illustrate the minimum safe driving distance or vehicle spacing between consecutive vehicles for both dry road conditions and wet road conditions for a reaction time of the driver of 0, 1 second, and 2 seconds, respectively. From day-to-day experience, a driver qualitatively knows that he/she has to drive at a large following distance for a large vehicle speed. Equation (6) and FIG. 7B include effects from road conditions, for example, dry road conditions, wet road conditions, snow-covered road conditions, as manifested by the value of a. A larger a, such as from a dry road rather than a wet road, results in a smaller vehicle spacing, which lines up with the drivers qualitative daily experience. Thus, equation (6) and FIGS. 7A-7B function as a quantitative guidance on safe driving distances for vehicles with autonomous or human drivers.

Figure 8A:
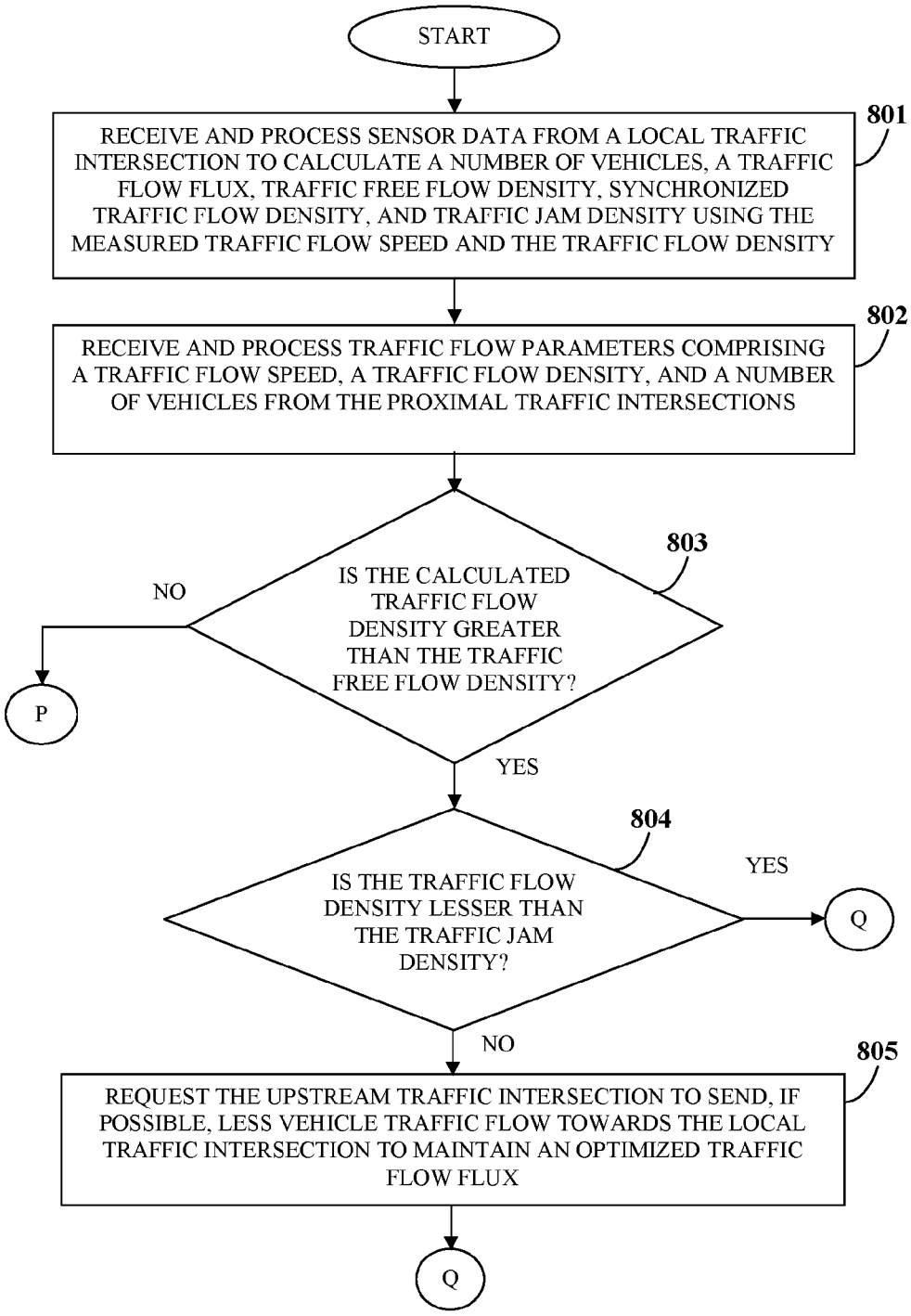
FIGS. 8A-8B exemplarily illustrate a flowchart comprising the steps of the method for predicting and controlling vehicle traffic flow through a traffic intersection dynamically with proximal traffic intersections.
Figure 8B:
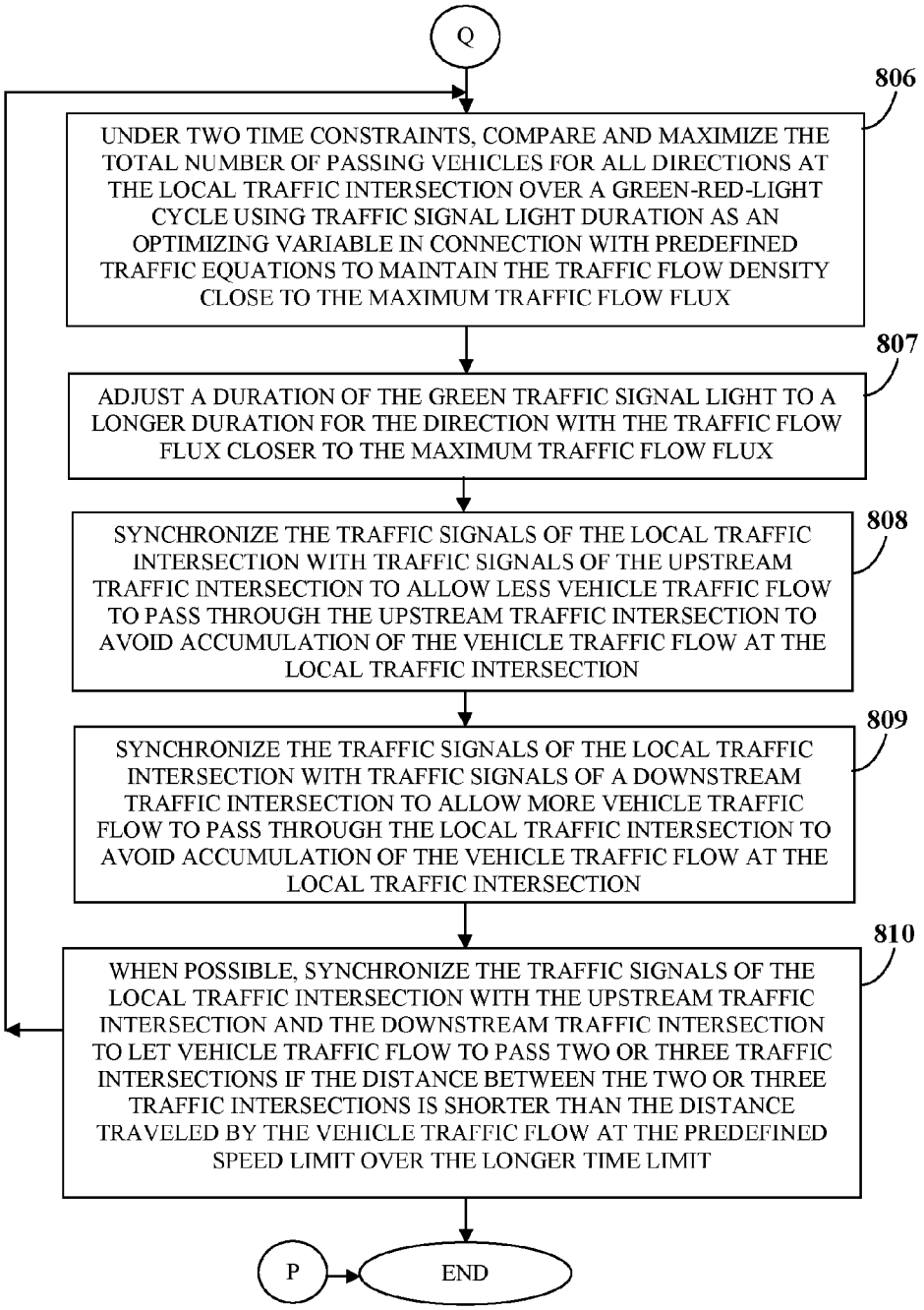

FIGS. 8A-8B exemplarily illustrate a flowchart comprising the steps of the method for predicting and controlling vehicle traffic flow through a traffic intersection dynamically with proximal traffic intersections. The traffic prediction and control system (TPCS) receives and processes 801 sensor data, for example, video data, LIDAR data, etc., from a local traffic intersection to calculate a number of vehicles in front of and passing through the local traffic intersection, a traffic flow flux, a traffic free flow density, a synchronized traffic flow density, and a traffic jam density using the measured traffic flow speed and the traffic flow density. The TPCS calculates the traffic flow flux by multiplying the traffic flow speed with the traffic flow density. The TPCS wirelessly receives and processes 802 computed data, that is, the traffic flow parameters comprising a traffic flow speed, a traffic flow density, and a number of vehicles in front of and passing through each of the proximal traffic intersections, from the proximal traffic intersections via a communication network. The TPCS determines 803 whether the calculated traffic flow density is greater than the traffic free flow density, where the traffic free flow density is calculated using equation (9) disclosed in the detailed description of FIGS. 1A-1B. If the calculated traffic flow density is not greater than the traffic free flow density, the TPCS terminates the process. If the calculated traffic flow density is greater than the traffic free flow density, the TPCS determines 804 whether the traffic flow density is lesser than the traffic jam density, where the traffic jam density is calculated using equation (20) disclosed in the detailed description of FIGS. 3A-3B. If the traffic flow density is not lesser than the traffic jam density, the TPCS communicates with one or more of the proximal traffic intersections via the communication network and requests one or more of the proximal traffic intersections to send more or less vehicle traffic flow towards the local traffic intersection to maintain an optimized maximum traffic flow flux. For example, the TPCS wirelessly requests 805 the upstream traffic intersection to send, if possible, less vehicle traffic flow towards the local traffic intersection to maintain an optimized traffic flow flux by instructing the upstream traffic intersection to adjust the duration of the traffic signals so that less number of vehicles reach the local traffic intersection and that the average traffic flow density over the distance between the two traffic intersections is, for example, less than 0.82 vehicles/$L_0$ corresponding to a vehicle escaping rate from a traffic jam stop of 0.18 vehicles/second, where $L_0$ is the average vehicle length.

If the traffic flow density is lesser than the traffic jam density, the traffic prediction and control system (TPCS), under two time constraints, the first time constraint being a long duration due to human drivers' patience to wait for a red traffic signal light turning and the second time constraint being a short duration that defines a crosswalk time for pedestrians on the cross directions, compares and maximizes 806 the total number of passing vehicles for all directions at the local traffic intersection over a green-red-light cycle using traffic signal light duration and direction of upstream traffic intersection traffic flow, for example, allowing more vehicle traffic flow through or less vehicle traffic flow through, as optimizing variables in connection with the following predefined traffic equations, that is, the traffic flow flux-traffic flow density and traffic flow flux-traffic flow speed equations to maintain the traffic flow flux closer to the maximum traffic flow flux. The TPCS determines a maximum of a sum of passing vehicles in all directions.

The traffic prediction and control system (TPCS) determines the beginning of a duration of a green traffic signal light for no-turn accelerated vehicles using the following equation:

$$t_{green} = t_{delay} + t_a = -\frac{t_{delay}}{2bL_0}\ln\left(1 - \frac{b}{a_c}v_{steady}^2\right) + \frac{1}{\sqrt{a_c b}}\ln\frac{1+\sqrt{\frac{b}{a_c}}\,v_{steady}}{1-\sqrt{\frac{b}{a_c}}\,v_{steady}} \tag{24}$$

where b is the normalized air drag coefficient, $t_{delay}$ is the delay time for a vehicle stopped at a red light to start moving after its leading vehicle moved when the red light is turning, $L_0$ is the average vehicle length, $v_{steady}$ is the steady speed after the acceleration process, and $a_c$ is vehicle acceleration in equation (24).

The traffic prediction and control system (TPCS) determines the beginning of a duration of a green traffic signal light for left-turn vehicles using the following equation:

$$t_{green} = \frac{1}{\sqrt{a_c b}}\ln\frac{1+\sqrt{\frac{b}{a_c}}\,v_{left}}{1-\sqrt{\frac{b}{a_c}}\,v_{left}} \tag{25}$$

where b is the normalized air drag coefficient, and $a_c$ is vehicle acceleration in equation (25).

For the duration of the green traffic signal light, after the traffic flow speed reaches a steady state, the traffic prediction and control system (TPCS) calculates the number of vehicles passing through the local traffic intersection using the following equation:

$$N=\int_0^{t_{green}}\rho(t)v(t)dt \tag{26}$$

where in equation (26), ρ(t) is the traffic flow density and v(t) is the traffic flow speed and $t_{green}$ is the green traffic signal light duration.

The traffic prediction and control system (TPCS) determines the number of vehicles passing through the traffic intersection when the green traffic signal light changes to a yellow traffic signal light using the following equation:

$$N=\int_0^{t_a}\rho(t)v(t)dt+\int_{t_a}^{green}\rho(t)v(t)dt\approx\tfrac{1}{2}q_{steady}t_a+q_{steady}(t_{green}-t_a) \tag{27}$$

where in equation (27), N is the number of vehicles, $q_{steady}$ is the traffic flow flux after the acceleration process, and $t_b$ is in accordance with equation (19) disclosed in the detailed description of FIGS. 3A-3B.

The traffic prediction and control system (TPCS) adjusts 807 the duration of the green traffic signal light to a longer duration for the direction with the traffic flow flux closer to the maximum traffic flow flux curve exemplarily illustrated in the FIG. 5A. The TPCS then synchronizes 808 the traffic signals of the local traffic intersection with the traffic signals of the nearest upstream traffic intersection to allow less vehicle traffic flow to pass through the upstream traffic intersection, if the traffic flow flux at the upstream traffic intersection is not greater than the traffic flow flux at the local traffic intersection. The TPCS synchronizes 809 the traffic signals of the local traffic intersection with the traffic signals of the nearest downstream traffic intersection, if the traffic flow flux at the downstream traffic intersection is not greater than the traffic flow flux at the local traffic intersection, to allow more vehicles to pass through the local traffic intersection. The TPCS performs the steps 808 and 809 disclosed above to avoid accumulation of the vehicle traffic flow at the local traffic intersection. When possible, the TPCS synchronizes 810 the traffic signals of the local traffic intersection with the proximal traffic intersections, for example, the upstream traffic intersection and the downstream traffic intersection to allow vehicle traffic flow to pass two or three traffic intersections if the distance between the two or three traffic intersections is shorter than the distance traveled by the vehicle traffic flow at the predefined speed limit over the longer time limit. The TPCS calculates the time required for the vehicle traffic flow to run between two traffic intersections as the distance divided by the speed limit.

Figure 9A:
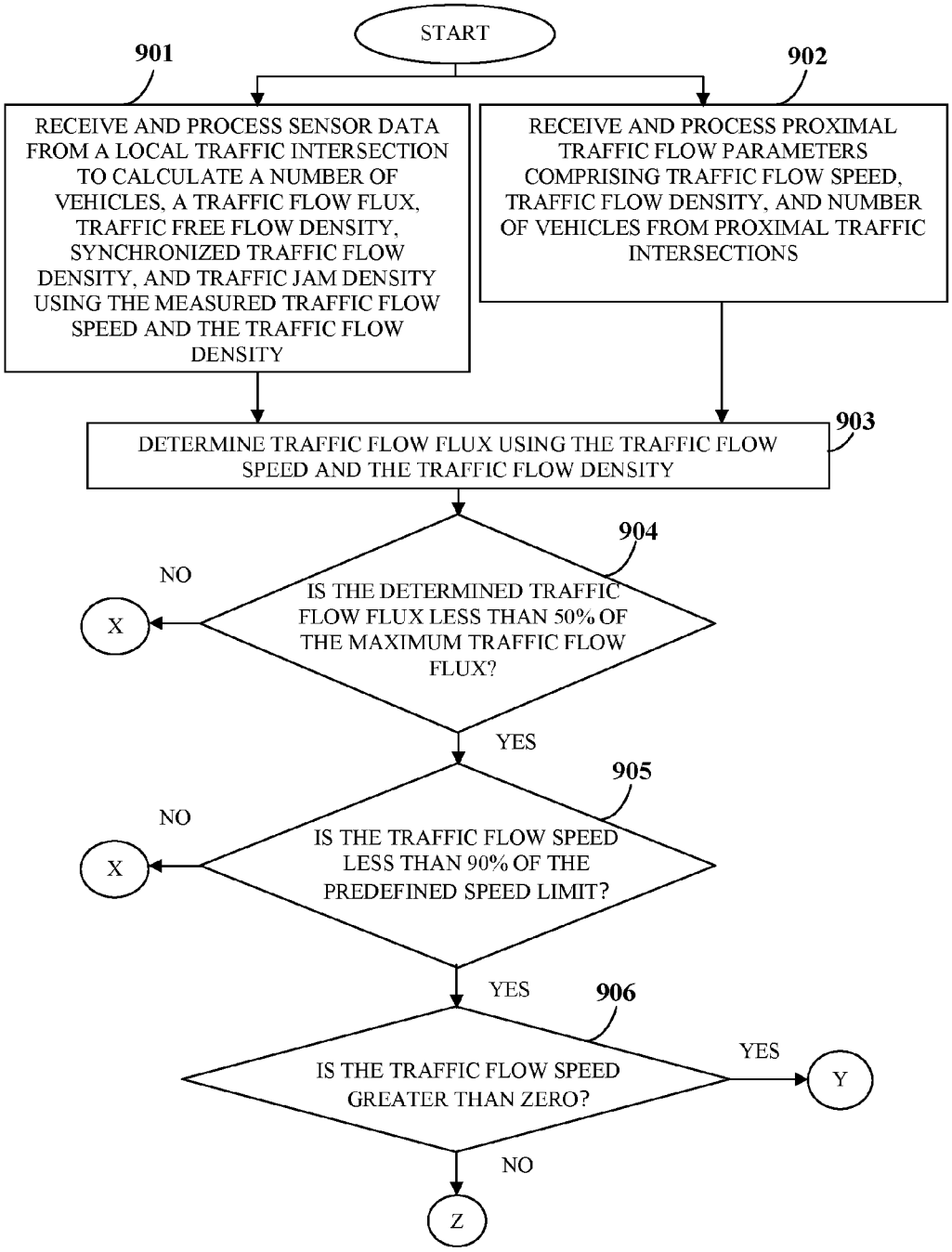
FIGS. 9A-9B exemplarily illustrate a flowchart comprising the steps of an embodiment of the method for predicting and controlling vehicle traffic flow through a traffic intersection dynamically with proximal traffic intersections.
Figure 9B:
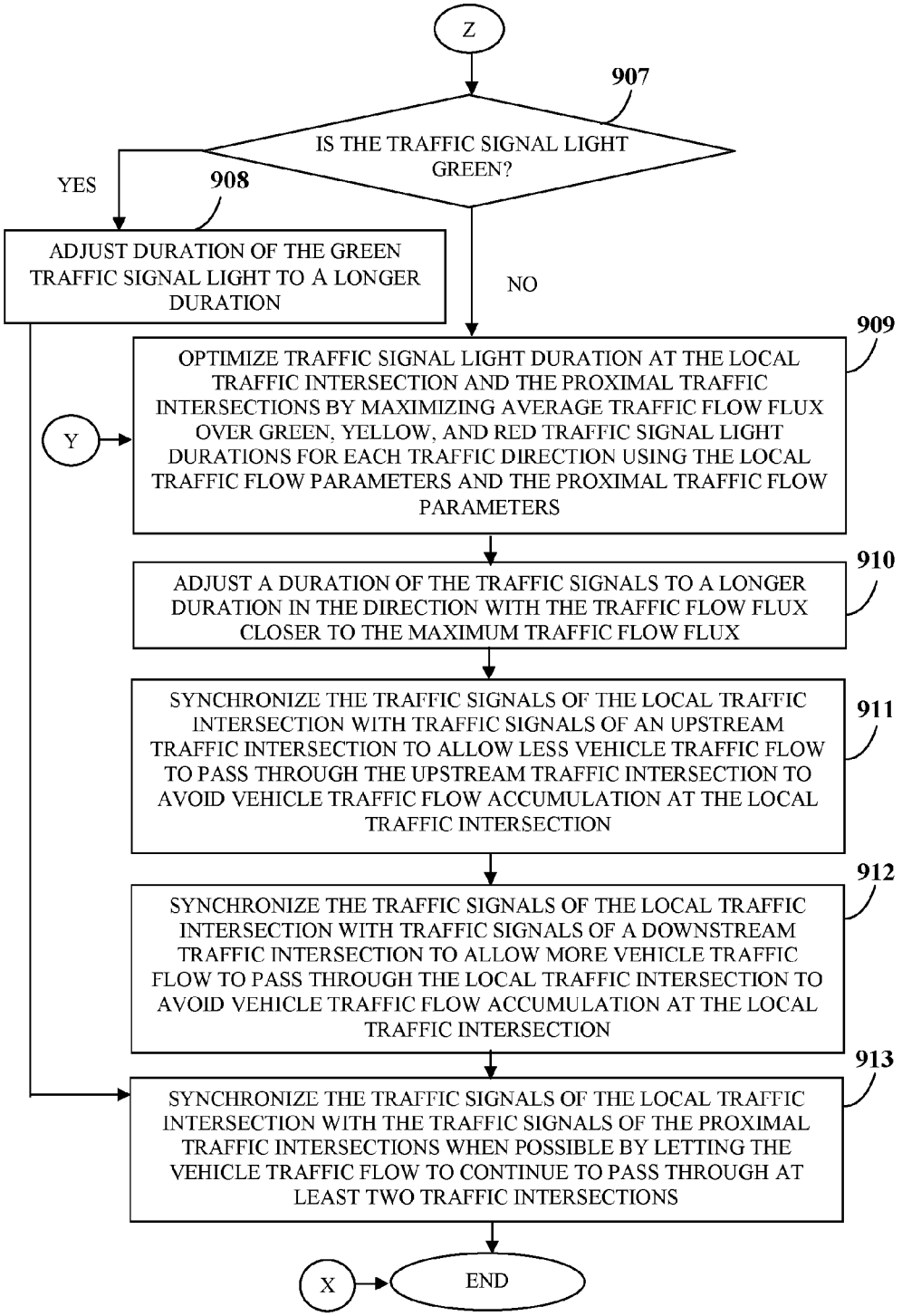

FIGS. 9A-9B exemplarily illustrate a flowchart comprising the steps of an embodiment of the method for predicting and controlling vehicle traffic flow through a traffic intersection dynamically with proximal traffic intersections. The traffic prediction and control system (TPCS) receives and processes 901 sensor data from a local traffic intersection to calculate a number of vehicles, a traffic flow flux, a traffic free flow density, a synchronized traffic flow density, and a traffic jam density using the measured traffic flow speed and the traffic flow density. The TPCS also receives and processes 902 proximal traffic flow parameters comprising the traffic flow speed, the traffic flow density, and the number of vehicles from the proximal traffic intersections via a communication network. The TPCS dynamically determines 903 a traffic flow flux using the traffic flow speed and the traffic flow density. The TPCS determines 904 whether, at a given traffic flow density, the traffic flow flux is less than a predetermined value, for example, 50% of the maximum traffic flow flux as exemplarily illustrated by a dashed line in FIG. 3A, and by a solid curve for vehicle to vehicle and autonomous vehicle flow as exemplarily illustrated in FIG. 3B. If the traffic flow flux is not less than 50% of the maximum traffic flow flux, the TPCS terminates the process. If the traffic flow flux is less than 50% of the maximum traffic flow flux, the TPCS determines 905 whether the traffic flow speed is less than a predetermined value, for example, 90% of the predefined speed limit. If the traffic flow speed is not less than the predetermined value of the speed limit, the TPCS terminates the process.

If the traffic flow speed is less than the predetermined value of the speed limit, the traffic prediction and control system (TPCS) determines 906 whether the traffic flow speed is greater than zero. If the traffic flow speed is greater than zero, the TPCS at the local traffic intersection optimizes 909 the traffic signal light duration at the local traffic intersection and the proximal traffic intersections by maximizing the average traffic flow flux over green, yellow and red traffic signal light durations for each traffic flow direction based on the sensor data of the local traffic intersection and the received data, that is, the proximal traffic flow parameters from the proximal traffic intersections. After optimization of the traffic signal light duration at the local traffic intersection and the proximal traffic intersections, the TPCS adjusts 910 a duration of the traffic signals to a longer duration in the direction with the traffic flow flux closer to the maximum traffic flow flux. The TPCS synchronizes 911 the traffic signals of the local traffic intersection with the traffic signals of the nearest upstream traffic intersection to allow less vehicle traffic flow to pass through the upstream traffic intersection to avoid vehicle traffic flow accumulation at the local traffic intersection. The TPCS also synchronizes 912 the traffic signals of the local traffic intersection with the traffic signals of the downstream traffic intersection to allow more vehicle traffic flow to pass through the local traffic intersection to avoid vehicle traffic flow accumulation at the local traffic intersection and proceeds to step 913. If the traffic flow speed is not greater than zero, the TPCS determines 907 whether the traffic signal light is green. If the traffic signal light is green, the TPCS adjusts 908 the duration of the green traffic signal light to a longer duration and then synchronizes 913 the traffic signals of the local traffic intersection with the traffic signals of the nearest downstream traffic intersection, if the traffic flow flux at the downstream traffic intersection is not greater than the traffic flow flux at the local traffic intersection, to allow more vehicle traffic flow to pass through at least two traffic intersections. The TPCS then synchronizes the traffic signals of the local traffic intersection with the traffic signals of the nearest upstream traffic intersection to allow less vehicle traffic flow to pass through the upstream traffic intersection, if the traffic flow flux is not greater than the traffic flow flux at the local traffic intersection.

FIGS. 10A-10D exemplarily illustrate embodiments of a system 1000 comprising the traffic prediction and control system (TPCS) 1001 for predicting and controlling vehicle traffic flow through a traffic intersection 1004 dynamically with proximal traffic intersections 1005 and 1006. In the system 1000 disclosed herein as exemplarily illustrated in the FIG. 10A, the TPCS 1001 is configured in a local traffic intersection 1004 having traffic signals 1004*a*, and also in each of the proximal traffic intersections 1005 and 1006 having traffic signals 1005*a* and 1006*a* respectively. The proximal traffic intersections 1005 and 1006 comprise an upstream traffic intersection 1005 and a downstream traffic intersection 1006 with respect to the local traffic intersection 1004. The TPCS 1001 at each of the traffic intersections 1004, 1005, and 1006 communicate with each other via a communication network 1003. The communication network 1003 is, for example, the internet, an intranet, a wired network, a wireless network, a communication network that implements Bluetooth® of Bluetooth Sig, Inc., a network that implements Wi-Fi® of Wi-Fi Alliance Corporation, an ultra-wideband communication network (UWB), a wireless universal serial bus (USB) communication network, a communication network that implements ZigBee® of ZigBee Alliance Corporation, a general packet radio service (GPRS) network, a mobile telecommunication network such as a global system for mobile (GSM) communications network, a code division multiple access (CDMA) network, a third generation (3G) mobile communication network, a fourth generation (4G) mobile communication network, a fifth generation (5G) mobile communication network, a long-term evolution (LTE) mobile communication network, a public telephone network, etc., a local area network, a wide area network, an internet connection network, etc., or a network formed from any combination of these networks.

The traffic prediction and control system (TPCS) 1001 disclosed herein comprises a non-transitory computer readable storage medium, for example, a memory unit 1001*f* and at least one processor 1001*d* communicatively coupled to the non-transitory computer readable storage medium. As used herein, "non-transitory computer readable storage medium" refers to all computer readable media, for example, non-volatile media such as optical discs or magnetic disks, volatile media such as a register memory, a processor cache, etc., and transmission media such as wires that constitute a system bus coupled to the processor 1001*d*, except for a transitory, propagating signal. Non-volatile media comprise, for example, solid state drives, optical discs or magnetic disks, and other persistent memory volatile media including a dynamic random access memory (DRAM), which typically constitutes a main memory. Volatile media comprise, for example, a register memory, a processor cache, a random access memory (RAM), etc. Transmission media comprise, for example, coaxial cables, copper wire, fiber optic cables, modems, etc., including wires that constitute a system bus coupled to the processor 1001*d*, etc. The non-transitory computer readable storage medium is configured to store computer program instructions defined by modules, for example, 1001*g*, 1001*h*, 1001*i*, 1001*j*, 1001*k*, 1001*l*, 1001*m*, etc., of the TPCS 1001 exemplarily illustrated in FIG. 10B. The processor 1001*d* is configured to execute the defined computer program instructions.

Figure 10A:
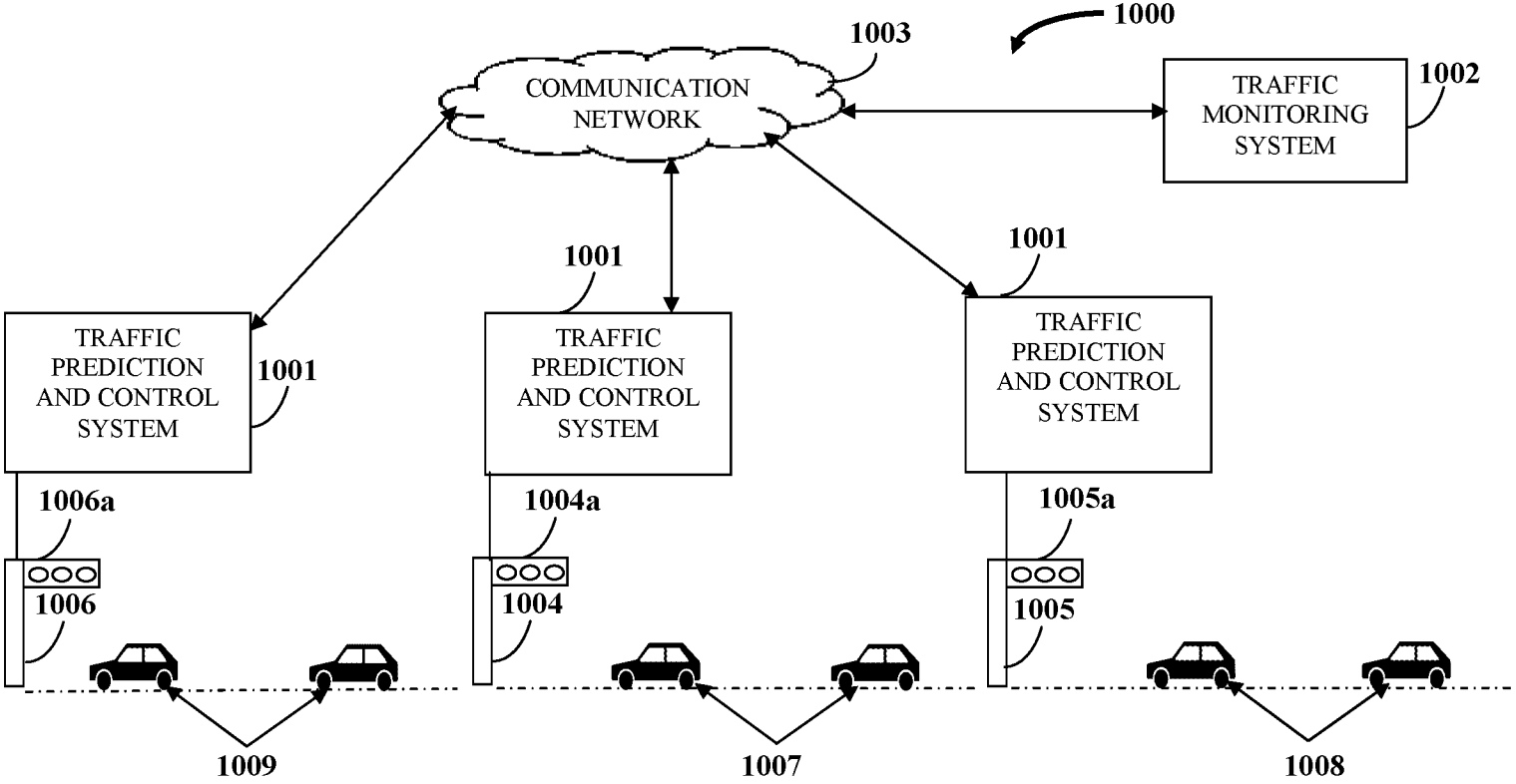
FIGS. 10A-10D exemplarily illustrate embodiments of a system comprising a traffic prediction and control system for predicting and controlling vehicle traffic flow through a traffic intersection dynamically with proximal traffic intersections.
Figure 10B:
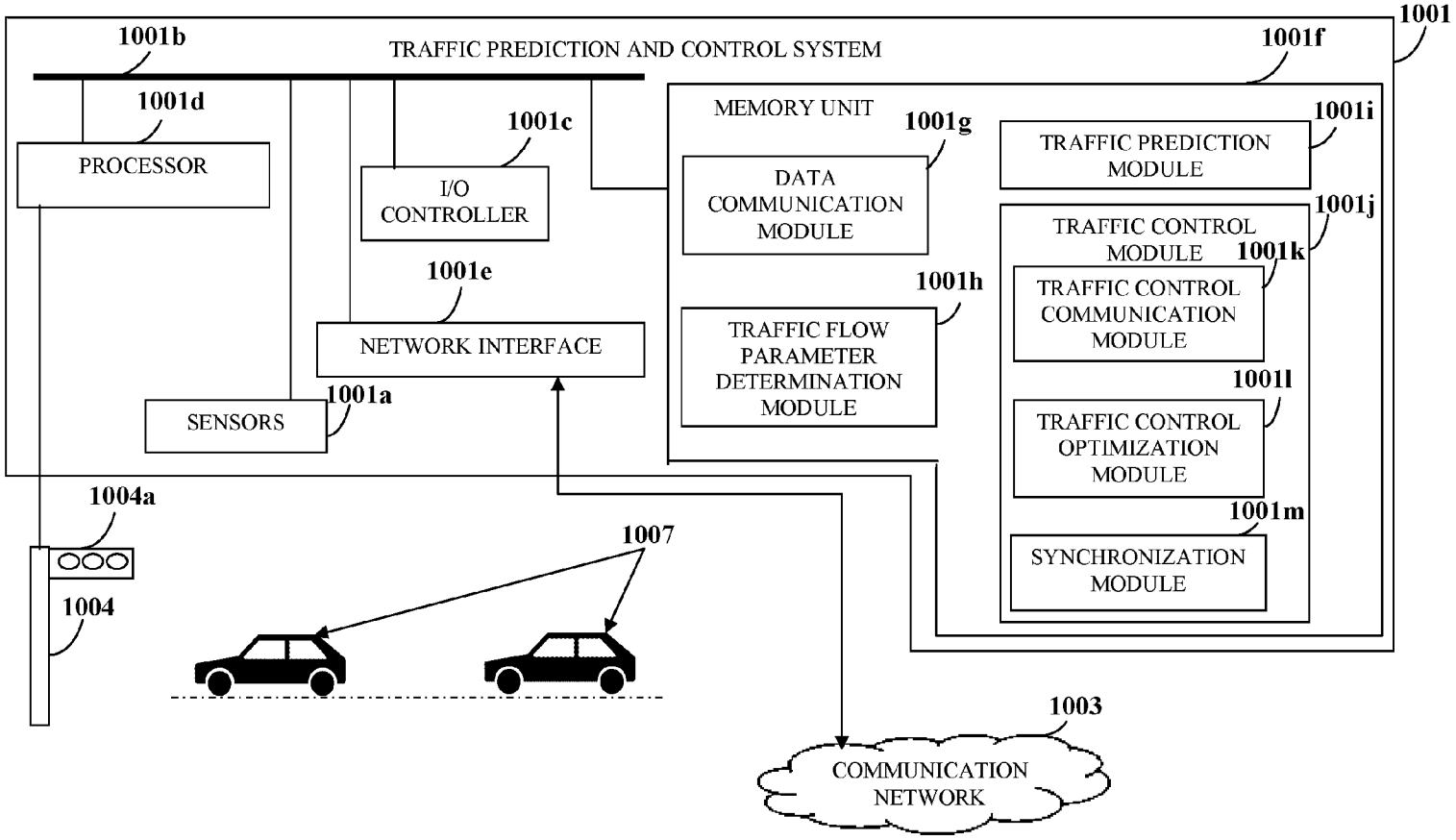

As exemplarily illustrated in FIG. 10B, the traffic prediction and control system (TPCS) 1001 disclosed herein further comprises a data communication module 1001*g*, a traffic flow parameter determination module 1001*h*, a traffic prediction module 1001*i*, and a traffic control module 1001*j* stored in the memory unit 1001*f*. The memory unit 1001*f* is used for storing programs, applications, and data. The memory unit 1001*f* is, for example, a random access memory (RAM) or another type of dynamic storage device that stores information and instructions for execution by the processor 1001*d*. The memory unit 1001*f* also stores temporary variables and other intermediate information used during execution of the instructions by the processor 1001*d*. The TPCS 1001 further comprises a read only memory (ROM) or another type of static storage device that stores static information and instructions for the processor 1001*d*.

The processor 1001*d* refers to any one or more microprocessors, central processing unit (CPU) devices, graphics processing units, finite state machines, computers, microcontrollers, digital signal processors, logic, a logic device, an electronic circuit, an application specific integrated circuit (ASIC), a field-programmable gate array (FPGA), a chip, etc., or any combination thereof, capable of executing computer programs or a series of commands, instructions, or state transitions. In an embodiment, the processor 1001*d* is implemented as a processor set comprising, for example, a programmed microprocessor and a math or graphics co-processor. The processor 1001*d* is selected, for example, from the Intel® processors such as the Itanium® microprocessor or the Pentium® processors, Advanced Micro Devices (AMD®) processors such as the Athlon® processor, UltraSPARC® processors, microSPARC® processors, Hp® processors, International Business Machines (IBM®) processors such as the PowerPC® microprocessor, the MIPS® reduced instruction set computer (RISC) processor of MIPS Technologies, Inc., RISC based computer processors of ARM Holdings, Motorola® processors, Qualcomm® processors, etc. The traffic prediction and control system (TPCS) 1001 disclosed herein is not limited to employing a processor 1001*d*. In an embodiment, the TPCS 1001 employs a controller or a microcontroller. The processor 1001*d* of the TPCS 1001 executes the modules, for example, 1001*g*, 1001*h*, 1001*i*, 1001*j*, 1001*k*, 1001*l*, 1001*m*, etc., of the TPCS 1001.

The traffic prediction and control system (TPCS) 1001 disclosed herein further comprises sensors 1001*a*, a data bus 1001*b*, an input/output (I/O) controller 1001*c*, and a network interface 1001*e*. One or more sensors 1001*a*, for example, video cameras, laser devices, inductive loop detectors, etc., are operably coupled to the processor 1001*d* and are in operable communication with one or more of the modules, for example, 1001*g*, 1001*m*, etc., of the TPCS 1001. The sensors 1001*a* detect the vehicle traffic flow through the traffic intersection 1004. The data bus 1001*b* permits communications between the modules, for example, 1001*g*, 1001*h*, 1001*i*, 1001*j*, 1001*k*, 1001*l*, 1001*m*, etc., of the TPCS 1001. The I/O controller 1001*c* controls input actions and output actions performed by the TPCS 1001. The network interface 1001*e* enables connection of the TPCS 1001 at each of the traffic intersections 1004, 1005, and 1006 to the communication network 1003. In an embodiment, the network interface 1001*e* is provided as an interface card also referred to as a line card. The network interface 1001*e* comprises, for example, one or more of an infrared (IR) interface, an interface implementing Wi-Fi® of Wi-Fi Alliance Corporation, a universal serial bus (USB) interface, a FireWire® interface of Apple Inc., an Ethernet interface, a frame relay interface, a cable interface, a digital subscriber line (DSL) interface, a token ring interface, a peripheral controller interconnect (PCI) interface, a local area network (LAN) interface, a wide area network (WAN) interface, interfaces using serial protocols, interfaces using parallel protocols, Ethernet communication interfaces, asynchronous transfer mode (ATM) interfaces, a high speed serial interface (HSSI), a fiber distributed data interface (FDDI), interfaces based on transmission control protocol (TCP)/internet protocol (IP), interfaces based on wireless communications technology such as satellite technology, radio frequency (RF) technology, near field communication, etc.

The data communication module 1001*g* dynamically receives and processes sensor data from one or more sensors

1001*a* positioned at the local traffic intersection 1004. The traffic flow parameter determination module 1001*h* dynamically determines traffic flow parameters comprising a traffic flow speed, a traffic flow density, and a number of vehicles 1007 and 1008 proximal to the local traffic intersection 1004 using the dynamically received and processed sensor data. The traffic flow parameter determination module 1001*h* dynamically determines a traffic flow flux using the dynamically determined traffic flow parameters. The data communication module 1001*g* also receives and processes analytical parameters comprising, for example, an average reaction time of average drivers of the vehicles 1007 and 1008, an average traffic flow speed of the vehicles 1007 and 1008, an average vehicle mass, an average friction between the vehicles 1007 and 1008 and a road, an average air drag force of the vehicles 1007 and 1008, etc., from one or more sensors positioned at one or more proximal traffic intersections, for example, 1005 and 1006 via the communication network 1003. The traffic flow parameter determination module 1001*h* dynamically determines a minimum safe driving distance between a leading vehicle and a trailing vehicle among the vehicles 1007 proximal to the local traffic intersection 1004 using the dynamically received and processed analytical parameters. The traffic flow parameter determination module 1001*h* dynamically determines a traffic free flow density, a synchronized traffic flow density, and a traffic jam density using the dynamically determined minimum safe driving distance, the traffic flow speed, a predefined speed limit, a traffic jam speed, an average length of the vehicles 1007, road conditions, and one or more of the dynamically received and processed analytical parameters.

The traffic prediction module 1001*i* predicts transitions of the vehicle traffic flow across traffic flow phases through the local traffic intersection 1004 using the dynamically determined traffic free flow density, the dynamically determined synchronized traffic flow density, and the dynamically determined traffic jam density. The traffic control module 1001*j* controls the vehicle traffic flow through the local traffic intersection 1004 by dynamically adjusting duration of traffic signals 1004*a* of the local traffic intersection 1004 and transmitting traffic signal time adjustment instructions to the proximal traffic intersections 1005 and 1006 for adjusting the duration of the traffic signals 1005*a* and 1006*a* of the proximal traffic intersections 1005 and 1006 respectively based on the predicted transitions of the vehicle traffic flow from the local traffic intersection 1004.

In an embodiment, the traffic control module 1001*j* comprises a traffic control communication module 1001*k* and a traffic control optimization module 1001*l*. The traffic control communication module 1001*k* requests the upstream traffic intersection 1005 via the communication network 1003 to send more or less vehicle traffic flow towards the local traffic intersection 1004 to maintain an optimized traffic flow flux based on conditions associated with the traffic flow density and the traffic flow speed as disclosed in the detailed description of FIGS. 1A-1B. The traffic control optimization module 1001*l* dynamically determines and optimally controls a duration of a green traffic signal light for the vehicles 1007 moving in a direction with the dynamically determined traffic flow flux closer to or further away from the optimized traffic flow flux for the traffic flow speed and the traffic flow density at the local traffic intersection 1004 by using the dynamically determined traffic flow parameters and by controlling the vehicle traffic flow from the upstream traffic intersection 1005.

In an embodiment, the traffic control module 1001*j* further comprises a synchronization module 1001*m* for synchronizing the traffic signals 1004*a* of the local traffic intersection 1004 with traffic signals 1005*a* of the upstream traffic intersection 1005 exemplarily illustrated in FIG. 10A, to allow less vehicle traffic flow pass through the upstream traffic intersection 1005 to avoid accumulation of the vehicle traffic flow at the local traffic intersection 1004 based on the traffic flow flux at the upstream traffic intersection 1005 being not more than the traffic flow flux at the local traffic intersection 1004 and the traffic flow flux at the local traffic intersection 1004 being more than half of the maximum traffic flow flux. The synchronization module 1001*m* also synchronizes the traffic signals 1004*a* of the local traffic intersection 1004 with traffic signals 1006*a* of the downstream traffic intersection 1006 exemplarily illustrated in FIG. 10A, to allow more vehicle traffic flow to pass through the local traffic intersection 1004 to avoid accumulation of the vehicle traffic flow at the local traffic intersection 1004 based on the traffic flow flux between the downstream traffic intersection 1006 and a subsequent downstream traffic intersection being lesser than the traffic flow flux at the local traffic intersection 1004.

In an embodiment, the system 1000 disclosed herein further comprises a traffic monitoring system 1002 that communicates with the traffic prediction and control system (TPCS) 1001 via the communication network 1003. The TPCS 1001 is operably connected to the traffic monitoring system 1002 via the communication network 1003. In an embodiment, the I/O controller 1001*c* interfaces between the traffic monitoring system 1002 and the TPCS 1001. The traffic monitoring system 1002 monitors and overrides functions of the TPCS 1001 positioned at the local traffic intersection 1004 and each of the proximal traffic intersections 1005 and 1006 to maintain the optimized traffic flow flux.

Computer applications and programs are used for operating the traffic prediction and control system (TPCS) 1001. In an embodiment, the computer applications and programs are loaded into the memory unit 1001*f* directly via the communication network 1003. The processor 1001*d* of the TPCS 1001 executes an operating system, for example, the Linux® operating system, the Unix® operating system, any version of the Microsoft® Windows® operating system, the Mac OS® of Apple Inc., the IBM® OS/2, VxWorks® of Wind River Systems, Inc., QNX Neutrino® developed by QNX Software Systems Ltd., Palm OS®, the Solaris operating system developed by Sun Microsystems, Inc., the Android® operating system of Google Inc., the Windows Phone® operating system of Microsoft Corporation, the BlackBerry® operating system of BlackBerry Limited, the iOS operating system of Apple Inc., the Symbian™ operating system of Symbian Foundation Limited, etc. The TPCS 1001 employs the operating system for performing multiple tasks. The operating system is responsible for management and coordination of activities and sharing of resources of the TPCS 1001. The operating system further manages security of the TPCS 1001, peripheral devices connected to the TPCS 1001, and connections to the communication network 1003. The operating system employed on the TPCS 1001 recognizes, for example, inputs received by the TPCS 1001, the output display, files, and directories stored locally in the memory unit 1001*f*. The operating system of the TPCS 1001 executes different programs using the processor 1001*d*. The processor 1001*d* and the operating system together define a computer system for which application programs in high level programming languages are written.

The processor 1001*d* of the traffic prediction and control system (TPCS) 1001 retrieves instructions defined by the data communication module 1001*g*, the traffic flow parameter determination module 1001*h*, the traffic prediction module 1001*i*, and the traffic control communication module 1001*k*, the traffic control optimization module 1001*l*, and the synchronization module 1001*m* of the traffic control module 1001*j* for performing respective functions disclosed above. The processor 1001*d* retrieves instructions for executing the modules, for example, 1001*g*, 1001*h*, 1001*i*, 1001*j*, 1001*k*, 1001*l*, 1001*m*, etc., of the TPCS 1001 from the memory unit 1001*f*. A program counter determines the location of the instructions in the memory unit 1001*f*. The program counter stores a number that identifies the current position in the program of each of the modules, for example, 1001*g*, 1001*h*, 1001*i*, 1001*j*, 1001*k*, 1001*l*, 1001*m*, etc., of the TPCS 1001. The instructions fetched by the processor 1001*d* from the memory unit 1001*f*, after being processed, are decoded. The instructions are stored in an instruction register in the processor 1001*d*. After processing and decoding, the processor 1001*d* executes the instructions, thereby performing one or more processes defined by those instructions.

At the time of execution, the instructions stored in the instruction register are examined to determine the operations to be performed. The processor 1001*d* then performs the specified operations. The operations comprise arithmetic operations and logic operations. The operating system performs multiple routines for performing a number of tasks required to assign the memory for execution of the modules, for example, 1001*g*, 1001*h*, 1001*i*, 1001*j*, 1001*k*, 1001*l*, 1001*m*, etc., of the traffic prediction and control system (TPCS) 1001. The tasks performed by the operating system comprise, for example, assigning memory to the modules, for example, 1001*g*, 1001*h*, 1001*i*, 1001*j*, 1001*k*, 1001*l*, 1001*m*, etc., of the TPCS 1001, and to data used by the TPCS 1001, moving data between the memory unit 1001*f* and disk units, and handling input/output operations. The operating system performs the tasks on request by the operations and after performing the tasks, the operating system transfers the execution control back to the processor 1001*d*. The processor 1001*d* continues the execution to obtain one or more outputs. The outputs of the execution of the modules, for example, 1001*g*, 1001*h*, 1001*i*, 1001*j*, 1001*k*, 1001*l*, 1001*m*, etc., of the TPCS 1001 are used to control, for example, lights of the traffic signals 1004*a*, 1005*a*, and 1006*a*.

Figure 10C:
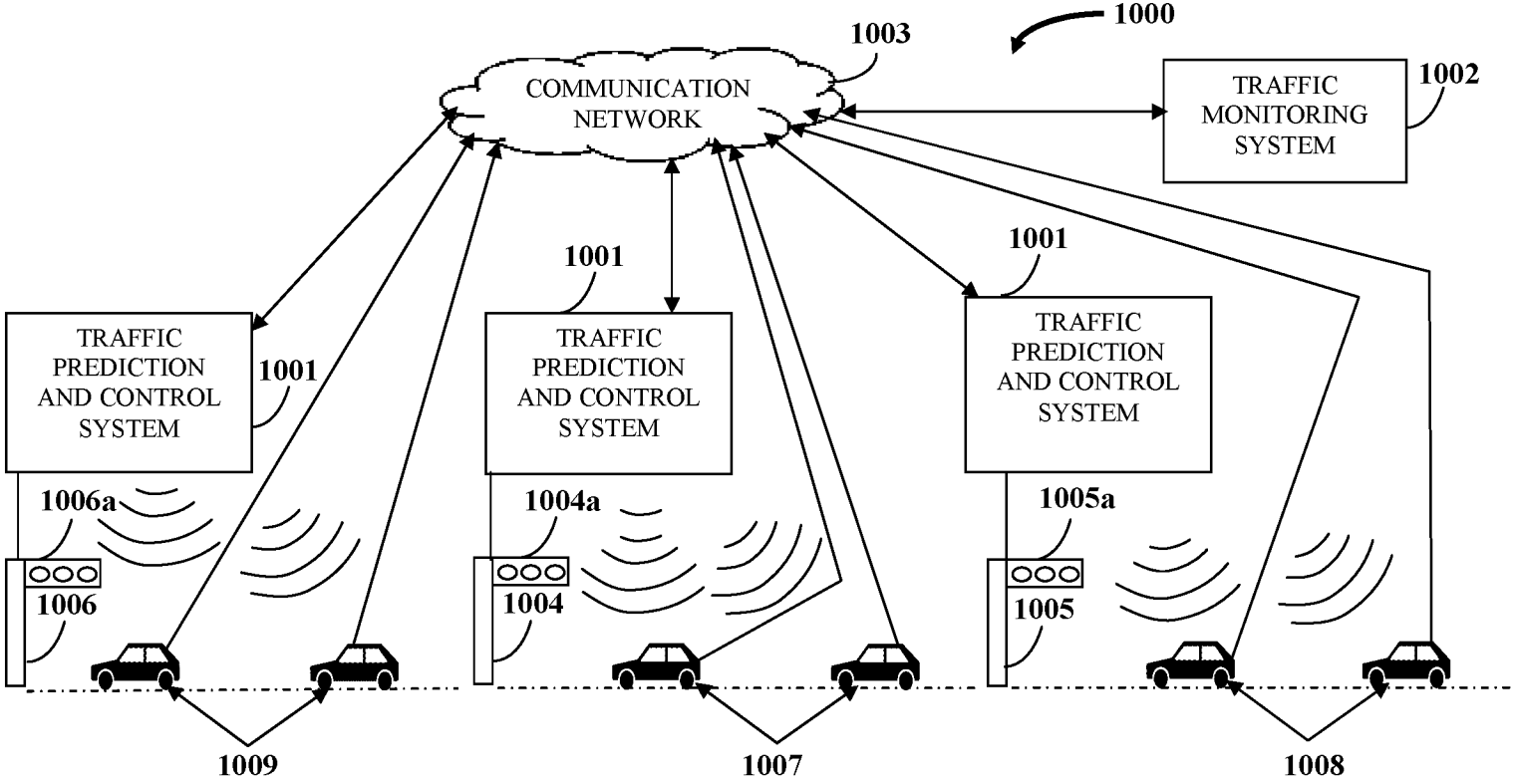

FIG. 10C exemplarily illustrates an embodiment of the system 1000 comprising the traffic prediction and control system (TPCS) 1001, where vehicles 1007, 1008, and 1009 communicate with the TPCS 1001 via the communication network 1003. In this embodiment, the TPCS 1001 receives analytical parameters from one or more sensors positioned in each of the vehicles 1007, 1008, and 1009 proximal to the local traffic intersection 1004 via the communication network 1003. The TPCS 1001 processes the received analytical parameters for predicting transitions of the vehicle traffic flow across the traffic flow phases and controlling the vehicle traffic flow through the local traffic intersection 1004.

Figure 10D:
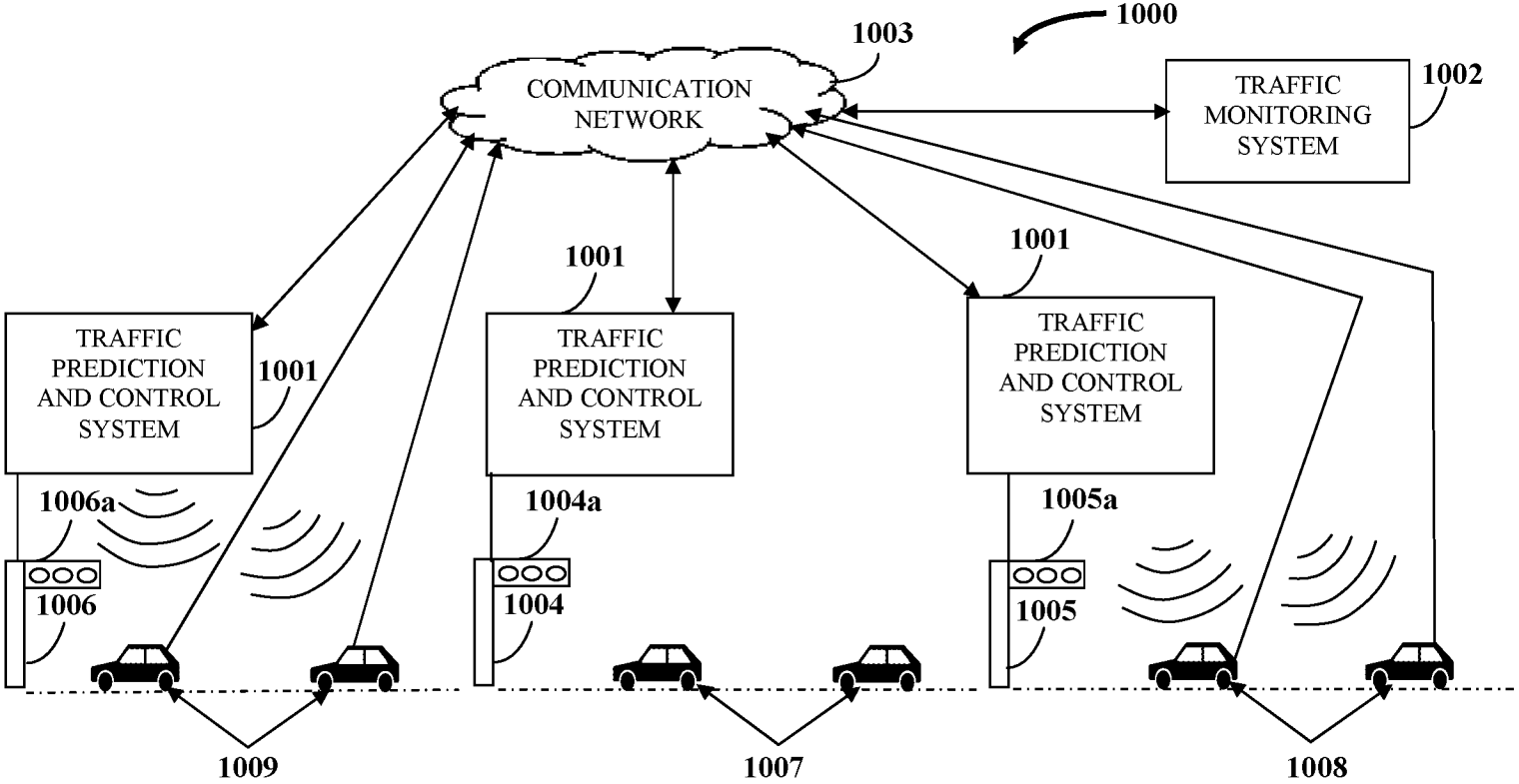

FIG. 10D exemplarily illustrates an embodiment of the system 1000 comprising the traffic prediction and control system (TPCS) 1001, where classified vehicles, for example, 1008 and 1009 communicate with the TPCS 1001 via the communication network 1003 to obtain a one-time priority pass to pass through the local traffic intersection 1004. In this embodiment, the traffic control optimization module 1001*l* of the TPCS 1001 exemplarily illustrated in FIG. 10B, assigns a one-time priority pass to classified vehicles 1008 and 1009, in operable communication with the TPCS 1001 over the communication network 1003, to allow the classified vehicles 1008 and 1009 to pass through the local traffic intersection 1004 before resuming normal operations. This predetermined class of vehicles 1008 and 1009 is wirelessly connected to the TPCS 1001 via the communication network 1003.

For purposes of illustration, the detailed description refers to the traffic prediction and control system (TPCS) 1001 being run locally as a single computer system; however the scope of the method and the TPCS 1001 disclosed herein are not limited to the TPCS 1001 being run locally as a single computer system via the operating system and the processor 1001*d* exemplarily illustrated in FIG. 10B, but may be extended to run remotely over the communication network 1003 by employing a web browser and a remote server, a mobile phone, or other electronic devices. In an embodiment, one or more portions of the TPCS 1001 are distributed across one or more computer systems (not shown) coupled to the communication network 1003.

Disclosed herein is also a non-transitory computer readable storage medium that stores computer program codes comprising instructions executable by at least one processor 1001*d* for predicting and controlling vehicle traffic flow through a traffic intersection 1004 dynamically with proximal traffic intersections 1005 and 1006. The computer program codes implement processes of various embodiments. The computer program codes comprise a first computer program code for dynamically receiving and processing sensor data from one or more sensors 1001*a* positioned at the local traffic intersection 1004; a second computer program code for dynamically determining traffic flow parameters comprising a traffic flow speed, a traffic flow density, and a number of vehicles 1007 proximal to the local traffic intersection 1004 using the dynamically received and processed sensor data; a third computer program code for dynamically determining a traffic flow flux using the dynamically determined traffic flow parameters; a fourth computer program code for dynamically receiving and processing analytical parameters from one or more sensors positioned at proximal traffic intersections 1005 and 1006 via the communication network 1003; a fifth computer program code for dynamically determining a minimum safe driving distance between a leading vehicle and a trailing vehicle among the vehicles 1007 proximal to the local traffic intersection 1004 using the dynamically received and processed analytical parameters; a sixth computer program code for dynamically determining a traffic free flow density, a synchronized traffic flow density, and a traffic jam density using the dynamically determined minimum safe driving distance, the traffic flow speed, a predefined speed limit, a traffic jam speed, an average length of the vehicles 1007, road conditions, and one or more of the dynamically received and processed analytical parameters; a seventh computer program code for predicting transitions of the vehicle traffic flow across traffic flow phases through the local traffic intersection 1004 using the dynamically determined traffic free flow density, the dynamically determined traffic jam density, the dynamically determined synchronized traffic flow density, and the dynamically determined traffic jam density; and an eighth computer program code for controlling the vehicle traffic flow through the local traffic intersection 1004 by dynamically adjusting duration of traffic signals 1004*a* of the local traffic intersection 1004 and transmitting traffic signal time adjustment instructions to each of the proximal traffic intersections 1005 and 1006 based on the predicted transitions of the vehicle traffic flow from the local traffic intersection 1004.

The eighth computer program code comprises a ninth computer program code for requesting the upstream traffic intersection 1005 via the communication network 1003 to send more or less vehicle traffic flow towards the local traffic intersection 1004 to maintain an optimized traffic flow flux based on conditions associated with the traffic flow density and the traffic flow speed; and a tenth computer program code for dynamically determining and optimally controlling the duration of a green traffic signal light for the vehicles 1007 moving in a direction with the dynamically determined local traffic flow flux closer to or further away from the optimized traffic flow flux for the traffic flow speed and the traffic flow density at the local traffic intersection 1004 by using the dynamically determined traffic flow parameters and by controlling the vehicle traffic flow from the upstream traffic intersection 1005. The eighth computer program code further comprises an eleventh computer program code for synchronizing the traffic signals 1004*a* of the local traffic intersection 1004 with traffic signals 1005*a* of the upstream traffic intersection 1005 to allow less vehicle traffic flow pass through the upstream traffic intersection 1005 to avoid accumulation of the vehicle traffic flow at the local traffic intersection 1004 based on the traffic flow flux at the upstream traffic intersection 1005 being not more than the traffic flow flux at the local traffic intersection 1004 and the traffic flow flux at the local traffic intersection 1004 being more than half of the maximum traffic flow flux. The eighth computer program code further comprises a twelfth computer program code for synchronizing the traffic signals 1004*a* of the local traffic intersection 1004 with traffic signals 1006*a* of the downstream traffic intersection 1006 to allow more vehicle traffic flow to pass through the local traffic intersection 1004 to avoid accumulation of the vehicle traffic flow at the local traffic intersection 1004 based on the traffic flow flux between the downstream traffic intersection 1006 and a subsequent downstream traffic intersection being lesser than the traffic flow flux at the local traffic intersection 1004. The eighth computer program code further comprises a thirteenth computer program code for assigning a one-time priority pass to classified vehicles, for example, 1008 and 1009 exemplarily illustrated in FIG. 10D, to allow the classified vehicles 1008 and 1009 to pass through the local traffic intersection 1004 before resuming normal operations.

The non-transitory computer readable storage medium disclosed herein further comprises one or more additional computer program codes for performing additional steps that may be required and contemplated for predicting and controlling vehicle traffic flow through a traffic intersection 1004 dynamically with proximal traffic intersections 1005 and 1006. In an embodiment, a single piece of computer program code comprising computer executable instructions performs one or more steps of the method disclosed herein for predicting and controlling vehicle traffic flow through a traffic intersection 1004 dynamically with proximal traffic intersections 1005 and 1006. The computer program codes comprising computer executable instructions are embodied on the non-transitory computer readable storage medium. The processor 1001*d* of the traffic prediction and control system 1001 retrieves these computer executable instructions and executes them. When the computer executable instructions are executed by the processor 1001*d*, the computer executable instructions cause the processor 1001*d* to perform the steps of the method for predicting and controlling vehicle traffic flow through a traffic intersection 1004 dynamically with proximal traffic intersections 1005 and 1006.

The method and the traffic prediction and control system (TPCS) 1001 disclosed herein enable the derivation of upper limits for traffic flow phases in the traffic flow flux-traffic flow speed and traffic flow flux-traffic flow density planes, which represents a significant advancement over the fundamental diagram that conventionally depicts a 1-to-1 relation between traffic flow flux and traffic flow density. The TPCS 1001 disclosed herein analyzes traffic jams quantitatively and obtains a phase diagram for vehicle traffic flows. The occurrence of traffic jams depends not only on the number of vehicles, but also on the shape of the upper boundary curve in the traffic flow flux-traffic flow speed plane, which is influenced by traffic flow speed, road conditions, vehicle mass, driver reaction time, friction, and air drag force on the vehicle. The TPCS 1001 derives quantitative conditions and properties for the occurrence of traffic jams, including jam speeds, jam densities, and density waves as disclosed above. The TPCS 1001 also determines that, when the traffic flow density $\rho<\rho_{free}$ with $\rho_{free}$ being a function of the designated or legal speed limit, road conditions, and human reaction time, the corresponding vehicle traffic flow is in, or in transition to, a free flow; when $\rho>\rho_{jam}$ with $\rho_{jam}$ being a function of road conditions and human reaction time, the corresponding vehicle traffic flow is in, or in transition to, a jam traffic flow; and when $\rho_{free}\leq\rho\leq\rho_{jam}$, the corresponding vehicle traffic flow is in, or in transition to, a synchronized traffic flow.

The method and the traffic prediction and control system (TPCS) 1001 disclosed herein determines road capacity, maximum safe traffic flow density, and proper vehicle spacing for vehicles in vehicle traffic flows with or without human drivers. The relations determined by the TPCS 1001 can be utilized to shift traffic systems from individual drivers acting locally and/or sequentially towards concerted global actions, resulting in optimized travel efficiency and traffic throughput across the road network. The road capacity can be doubled by collectively eliminating human reaction time, with an implication of eliminating or reducing the need for road infrastructure expansion, and providing long-needed relief of traffic jams. This doubling can be realized by using wirelessly connected vehicles 1008 and 1009 exemplarily illustrated in FIGS. 10C-10D, with or without human drivers. The collective elimination of human reaction time also facilities globally concerted and efficient traffic merging, traffic redirection and control, and speed-limit-design. The TPCS 1001 also resolves the long-standing problem of the minimum safe driving distance with results applicable to scenarios beyond the limits of human driver reaction time and show its effect on the fundamental diagram. This relation is critical for emerging wirelessly connected vehicles 1008 and 1009, with or without human drivers, to determine proper vehicle spacing in motion.

It will be readily apparent in different embodiments that the various methods, algorithms, and computer programs disclosed herein are implemented on non-transitory computer readable storage media appropriately programmed for computing devices. The non-transitory computer readable storage media participate in providing data, for example, instructions that are read by a computer, a processor or a similar device. In different embodiments, the "non-transitory computer readable storage media" further refers to a single medium or multiple media, for example, a centralized database, a distributed database, and/or associated caches and servers that store one or more sets of instructions that are read by a computer, a processor or a similar device. The "non-transitory computer readable storage media" further refers to any medium capable of storing or encoding a set of instructions for execution by a computer, a processor or a similar device and that causes a computer, a processor or a similar device to perform any one or more of the methods disclosed herein. Common forms of non-transitory computer readable storage media comprise, for example, a floppy disk, a flexible disk, a hard disk, magnetic tape, a laser disc, a Blu-ray Disc® of the Blu-ray Disc Association, any magnetic medium, a compact disc-read only memory (CD-ROM), a digital versatile disc (DVD), any optical medium, a flash memory card, punch cards, paper tape, any other physical medium with patterns of holes, a random access memory (RAM), a programmable read only memory (PROM), an erasable programmable read only memory (EPROM), an electrically erasable programmable read only memory (EEPROM), a flash memory, any other memory chip or cartridge, or any other medium from which a computer can read.

In an embodiment, the computer programs that implement the methods and algorithms disclosed herein are stored and transmitted using a variety of media, for example, the computer readable media in a number of manners. In an embodiment, hard-wired circuitry or custom hardware is used in place of, or in combination with, software instructions for implementing the processes of various embodiments. Therefore, the embodiments are not limited to any specific combination of hardware and software. The computer program codes comprising computer executable instructions can be implemented in any programming language. Examples of programming languages that can be used comprise C, C++, C#, Java®, JavaScript®, Fortran, Ruby, Perl®, Python Visual Basic®, hypertext preprocessor (PHP), Microsoft® .NET, Objective-C®, etc. Other object-oriented, functional, scripting, and/or logical programming languages can also be used. In an embodiment, the computer program codes or software programs are stored on or in one or more mediums as object code. In another embodiment, various aspects of the method and the traffic prediction and control system 1001 disclosed herein are implemented as programmed elements, or non-programmed elements, or any suitable combination thereof.

The method and the traffic prediction and control system 1001 disclosed herein can be configured to work in a network environment comprising one or more computers that are in communication with one or more devices via the communication network 1003 exemplarily illustrated in FIGS. 10A-10D. In an embodiment, the computers communicate with the devices directly or indirectly, via a wired medium or a wireless medium such as the Internet, a local area network (LAN), a wide area network (WAN) or the Ethernet, a token ring, or via any appropriate communications mediums or combination of communications mediums. Each of the devices comprises processors, examples of which are disclosed above, that are adapted to communicate with the computers. In an embodiment, each of the computers is equipped with a network communication device, for example, a network interface card, a modem, or other network connection device suitable for connecting to the communication network 1003. Each of the computers and the devices executes an operating system, examples of which are disclosed above. While the operating system may differ depending on the type of computer, the operating system provides the appropriate communications protocols to establish communication links with the communication network 1003. Any number and type of machines may be in communication with the computers.

The method and the traffic prediction and control system (TPCS) 1001 disclosed herein are not limited to a particular computer system platform, processor, operating system, or network. In an embodiment, one or more aspects of the method and the TPCS 1001 disclosed herein are distributed among one or more computer systems, for example, servers configured to provide one or more services to one or more client computers, or to perform a complete task in a distributed system. For example, one or more aspects of the method and the TPCS 1001 disclosed herein are performed on a client-server system that comprises components distributed among one or more server systems that perform multiple functions according to various embodiments. These components comprise, for example, executable, intermediate, or interpreted code, which communicate over the communication network 1003 using a communication protocol. The method and the TPCS 1001 disclosed herein are not limited to be executable on any particular system or group of systems, and are not limited to any particular distributed architecture, network, or communication protocol.

The foregoing examples have been provided merely for the purpose of explanation and are in no way to be construed as limiting of the method and the traffic prediction and control system (TPCS) 1001 disclosed herein. While the method and the TPCS 1001 have been described with reference to various embodiments, it is understood that the words, which have been used herein, are words of description and illustration, rather than words of limitation. Further, although the method and the TPCS 1001 have been described herein with reference to particular means, materials, and embodiments, the method and the TPCS 1001 are not intended to be limited to the particulars disclosed herein; rather, the method and the TPCS 1001 extend to all functionally equivalent structures, methods and uses, such as are within the scope of the appended claims. Those skilled in the art, having the benefit of the teachings of this specification, may effect numerous modifications thereto and changes may be made without departing from the scope and spirit of the method and the TPCS 1001 disclosed herein in their aspects.

We claim:

1. A method for predicting and controlling vehicle traffic flow through a traffic intersection dynamically with proximal traffic intersections, the method employing a traffic prediction and control system comprising at least one processor configured to execute computer program instructions for performing the method, the method comprising:

dynamically receiving and processing sensor data from one or more sensors positioned at a local traffic intersection by the traffic prediction and control system;

dynamically determining traffic flow parameters comprising a traffic flow speed, a traffic flow density, and a number of vehicles proximal to the local traffic intersection by the traffic prediction and control system using the dynamically received and processed sensor data;

dynamically determining a traffic flow flux by the traffic prediction and control system using the dynamically determined traffic flow parameters;

dynamically receiving and processing analytical parameters from one or more sensors positioned at one or more proximal traffic intersections by the traffic prediction and control system via a communication network, wherein the one or more proximal traffic intersections comprise an upstream traffic intersection and a downstream traffic intersection with respect to the local traffic intersection;

dynamically determining a minimum safe driving distance between a leading vehicle and a trailing vehicle among the vehicles proximal to the local traffic intersection by the traffic prediction and control system using the dynamically received and processed analytical parameters;

dynamically determining a traffic free flow density, a synchronized traffic flow density, and a traffic jam density by the traffic prediction and control system using the dynamically determined minimum safe driving distance, the traffic flow speed, a predefined speed limit, a traffic jam speed, an average length of the vehicles, road conditions, and one or more of the dynamically received and processed analytical parameters;

predicting transitions of the vehicle traffic flow across traffic flow phases through the local traffic intersection by the traffic prediction and control system using the dynamically determined traffic free flow density, the dynamically determined synchronized traffic flow density, and the dynamically determined traffic jam density; and controlling the vehicle traffic flow through the local traffic intersection by the traffic prediction and control system by dynamically adjusting duration of traffic signals of the local traffic intersection and transmitting traffic signal time adjustment instructions to each of the one or more proximal traffic intersections based on the predicted transitions of the vehicle traffic flow from the local traffic intersection, wherein the control of the vehicle traffic flow through the local traffic intersection comprises:

requesting the upstream traffic intersection via the communication network to send one of more vehicle traffic flow and less vehicle traffic flow towards the local traffic intersection by the traffic prediction and control system to maintain an optimized traffic flow flux based on conditions associated with the traffic flow density and the traffic flow speed; and dynamically determining and optimally controlling a duration of a green traffic signal light for the vehicles moving in a direction with the dynamically determined traffic flow flux one of closer to and further away from the optimized traffic flow flux for the traffic flow speed and the traffic flow density at the local traffic intersection by the traffic prediction and control system by using the dynamically determined traffic flow parameters and by controlling the vehicle traffic flow from the upstream traffic intersection.

2. The method of claim 1, wherein the control of the vehicle traffic flow through the local traffic intersection by the traffic prediction and control system further comprises:

synchronizing the traffic signals of the local traffic intersection with traffic signals of the upstream traffic intersection to allow less vehicle traffic flow to pass through the upstream traffic intersection to avoid accumulation of the vehicle traffic flow at the local traffic intersection by the traffic prediction and control system based on the traffic flow flux at the upstream traffic intersection being not more than the traffic flow flux at the local traffic intersection and the traffic flow flux at the local traffic intersection being more than half of a maximum traffic flow flux; and synchronizing the traffic signals of the local traffic intersection with traffic signals of the downstream traffic intersection to allow more vehicle traffic flow to pass through the local traffic intersection to avoid accumulation of the vehicle traffic flow at the local traffic intersection by the traffic prediction and control system based on the traffic flow flux between the downstream traffic intersection and a subsequent downstream traffic intersection being lesser than the traffic flow flux at the local traffic intersection.

3. The method of claim 1, further comprising dynamically receiving and processing the analytical parameters from one or more sensors positioned in each of the vehicles proximal to the local traffic intersection by the traffic prediction and control system via the communication network for the determination of the minimum safe driving distance between the leading vehicle and the trailing vehicle among the vehicles proximal to the local traffic intersection and for the dynamic determination of the traffic free flow density, the synchronized traffic flow density, and the traffic jam density.

4. The method of claim 1, wherein the analytical parameters comprise an average reaction time of average drivers of the vehicles, an average traffic flow speed of the vehicles, an average vehicle mass, an average friction between the vehicles and a road, and an average air drag force of the vehicles.

5. The method of claim 1, wherein the conditions for controlling the vehicle traffic flow through the local traffic intersection comprise the traffic flow density being greater than the dynamically determined traffic free flow density, and the traffic flow density being lesser than the dynamically determined traffic jam density.

6. The method of claim 1, wherein the conditions for controlling the vehicle traffic flow through the local traffic intersection comprise the traffic flow speed being less than a predefined percentage of the predefined speed limit, and the traffic flow speed being greater than zero.

7. The method of claim 1, further comprising assigning a one-time priority pass to classified vehicles by the traffic prediction and control system to allow the classified vehicles to pass through the local traffic intersection before resuming normal operations, wherein the classified vehicles are in operable communication with the traffic prediction and control system over the communication network.

8. The method of claim 1, wherein the traffic flow phases comprise a traffic free flow phase, a synchronized traffic flow phase, and a jam traffic flow phase.

9. A traffic prediction and control system for predicting and controlling vehicle traffic flow through a traffic intersection dynamically with proximal traffic intersections, the traffic prediction and control system comprising:

a non-transitory computer readable storage medium configured to store computer program instructions defined by modules of the traffic prediction and control system;

at least one processor communicatively coupled to the non-transitory computer readable storage medium, the at least one processor configured to execute the defined computer program instructions;

a plurality of sensors operably coupled to the at least one processor and in operable communication with one or more of the modules of the traffic prediction and control system, the sensors configured to detect the vehicle traffic flow through the traffic intersection; and the modules of the traffic prediction and control system comprising:

a data communication module configured to dynamically receive and process sensor data from one or more of the sensors positioned at a local traffic intersection;

a traffic flow parameter determination module configured to dynamically determine traffic flow parameters comprising a traffic flow speed, a traffic flow density, and a number of vehicles proximal to the local traffic intersection using the dynamically received and processed sensor data;

the traffic flow parameter determination module further configured to dynamically determine a traffic flow flux using the dynamically determined traffic flow parameters;

the data communication module further configured to receive and process analytical parameters from one or more sensors positioned at one or more proximal traffic intersections via a communication network, wherein the one or more proximal traffic intersections comprise an upstream traffic intersection and a downstream traffic intersection with respect to the local traffic intersection;

the traffic flow parameter determination module further configured to dynamically determine a minimum safe driving distance between a leading vehicle and a trailing vehicle among the vehicles proximal to the local traffic intersection using the dynamically received and processed analytical parameters;

the traffic flow parameter determination module further configured to dynamically determine a traffic free flow density, a synchronized traffic flow density, and a traffic jam density using the dynamically determined minimum safe driving distance, the traffic flow speed, a predefined speed limit, a traffic jam speed, an average length of the vehicles, road conditions, and one or more of the dynamically received and processed analytical parameters;

a traffic prediction module configured to predict transitions of the vehicle traffic flow across traffic flow phases through the local traffic intersection using the dynamically determined traffic free flow density, the dynamically determined synchronized traffic flow density, and the dynamically determined traffic jam density; and a traffic control module configured to control the vehicle traffic flow through the local traffic intersection by dynamically adjusting duration of traffic signals of the local traffic intersection and transmitting traffic signal time adjustment instructions to each of the one or more proximal traffic intersections based on the predicted transitions of the vehicle traffic flow from the local traffic intersection, wherein the traffic control module comprises:

a traffic control communication module configured to request the upstream traffic intersection via the communication network to send one of more vehicle traffic flow and less vehicle traffic flow towards the local traffic intersection to maintain an optimized traffic flow flux based on conditions associated with the traffic flow density and the traffic flow speed; and a traffic control optimization module configured to dynamically determine and optimally control a duration of a green traffic signal light for the vehicles moving in a direction with the dynamically determined traffic flow flux one of closer to and further away from the optimized traffic flow flux for the traffic flow speed and the traffic flow density at the local traffic intersection by using the dynamically determined traffic flow parameters and by controlling the vehicle traffic flow from the upstream traffic intersection.

10. The traffic prediction and control system of claim 9, wherein the traffic control module further comprises a synchronization module configured to synchronize the traffic signals of the local traffic intersection with traffic signals of the upstream traffic intersection to allow less vehicle traffic flow pass through the upstream traffic intersection to avoid accumulation of the vehicle traffic flow at the local traffic intersection based on the traffic flow flux at the upstream traffic intersection being not more than the traffic flow flux at the local traffic intersection and the traffic flow flux at the local traffic intersection being more than half of a maximum traffic flow flux.

11. The traffic prediction and control system of claim 10, wherein the synchronization module is further configured to synchronize the traffic signals of the local traffic intersection with traffic signals of the downstream traffic intersection to allow more vehicle traffic flow to pass through the local traffic intersection to avoid accumulation of the vehicle traffic flow at the local traffic intersection based on the traffic flow flux between the downstream traffic intersection and a subsequent downstream traffic intersection being lesser than the traffic flow flux at the local traffic intersection.

12. The traffic prediction and control system of claim 9, wherein the analytical parameters comprise an average reaction time of average drivers of the vehicles, an average traffic flow speed of the vehicles, an average vehicle mass, an average friction between the vehicles and a road, and an average air drag force of the vehicles.

13. The traffic prediction and control system of claim 9, wherein the conditions for controlling the vehicle traffic flow through the local traffic intersection comprise the traffic flow density being greater than the dynamically determined traffic free flow density, and the traffic flow density being lesser than the dynamically determined traffic jam density.

14. The traffic prediction and control system of claim 9, wherein the conditions for controlling the vehicle traffic flow through the local traffic intersection comprise the traffic flow speed being less than a predefined percentage of the predefined speed limit, and the traffic flow speed being greater than zero.

15. The traffic prediction and control system of claim 9, wherein the traffic control optimization module is further configured to assign a one-time priority pass to classified vehicles to allow the classified vehicles to pass through the local traffic intersection before resuming normal operations, wherein the classified vehicles are in operable communication with the traffic prediction and control system over the communication network.

16. The traffic prediction and control system of claim 9 operably connected to a traffic monitoring system via the communication network, wherein the traffic monitoring system is configured to monitor and override functions of the traffic prediction and control system positioned at the local traffic intersection and the each of the one or more proximal traffic intersections to maintain the optimized traffic flow flux.

17. The traffic prediction and control system of claim 9, wherein the traffic flow phases comprise a traffic free flow phase, a synchronized traffic flow phase, and a jam traffic flow phase.

18. The traffic prediction and control system of claim 9, wherein the sensors comprise video cameras, laser devices, and inductive loop detectors.

19. A non-transitory computer readable storage medium having embodied thereon, computer program codes comprising instructions executable by at least one processor for predicting and controlling vehicle traffic flow through a traffic intersection dynamically with proximal traffic intersections, the computer program codes comprising:

a first computer program code for dynamically receiving and processing sensor data from one or more sensors positioned at a local traffic intersection;

a second computer program code for dynamically determining traffic flow parameters comprising a traffic flow speed, a traffic flow density, and a number of vehicles proximal to the local traffic intersection using the dynamically received and processed sensor data;

a third computer program code for dynamically determining a traffic flow flux using the dynamically determined traffic flow parameters;

a fourth computer program code for dynamically receiving and processing analytical parameters from one or more sensors positioned at one or more proximal traffic intersections via a communication network, wherein the one or more proximal traffic intersections comprise an upstream traffic intersection and a downstream traffic intersection with respect to the local traffic intersection;

a fifth computer program code for dynamically determining a minimum safe driving distance between a leading vehicle and a trailing vehicle among the vehicles proximal to the local traffic intersection using the dynamically received and processed analytical parameters;

a sixth computer program code for dynamically determining a traffic free flow density, a synchronized traffic flow density, and a traffic jam density using the dynamically determined minimum safe driving distance, the traffic flow speed, a predefined speed limit, a traffic jam speed, an average length of the vehicles, road conditions, and one or more of the dynamically received and processed analytical parameters;

a seventh computer program code for predicting transitions of the vehicle traffic flow across traffic flow phases through the local traffic intersection using the dynamically determined traffic free flow density, the dynamically determined synchronized traffic flow density, and the dynamically determined traffic jam density; and an eighth computer program code for controlling the vehicle traffic flow through the local traffic intersection by dynamically adjusting duration of traffic signals of the local traffic intersection and transmitting traffic signal time adjustment instructions to each of the one or more proximal traffic intersections based on the predicted transitions of the vehicle traffic flow from the local traffic intersection, wherein the eighth computer program code comprises:

a ninth computer program code for requesting the upstream traffic intersection via the communication network to send one of more vehicle traffic flow and less vehicle traffic flow towards the local traffic intersection to maintain an optimized traffic flow flux based on conditions associated with the traffic flow density and the traffic flow speed; and a tenth computer program code for dynamically determining and optimally controlling a duration of a green traffic signal light for the vehicles moving in a direction with the dynamically determined traffic flow flux one of closer to and further away from the optimized traffic flow flux for the traffic flow speed and the traffic flow density at the local traffic intersection by using the dynamically determined traffic flow parameters and by controlling the vehicle traffic flow from the upstream traffic intersection.

20. The non-transitory computer readable storage medium of claim 19, wherein the eighth computer program code further comprises:

an eleventh computer program code for synchronizing the traffic signals of the local traffic intersection with traffic signals of the upstream traffic intersection to allow less vehicle traffic flow pass through the upstream traffic intersection to avoid accumulation of the vehicle traffic flow at the local traffic intersection based on the traffic flow flux at the upstream traffic intersection being not more than the traffic flow flux at the local traffic intersection and the traffic flow flux at the local traffic intersection being more than half of a maximum traffic flow flux; and a twelfth computer program code for synchronizing the traffic signals of the local traffic intersection with traffic signals of the downstream traffic intersection to allow more vehicle traffic flow to pass through the local traffic intersection to avoid accumulation of the vehicle traffic flow at the local traffic intersection based on the traffic flow flux between the downstream traffic intersection and a subsequent downstream traffic intersection being lesser than the traffic flow flux at the local traffic intersection.

21. The non-transitory computer readable storage medium of claim 19, wherein the analytical parameters comprise an average reaction time of average drivers of the vehicles, an average traffic flow speed of the vehicles, an average vehicle mass, an average friction between vehicles and a road, and an average air drag force of the vehicles.

22. The non-transitory computer readable storage medium of claim 19, wherein the conditions for controlling the vehicle traffic flow through the local traffic intersection comprise the traffic flow density being greater than the dynamically determined traffic free flow density, and the traffic flow density being lesser than the dynamically determined traffic jam density.

23. The non-transitory computer readable storage medium of claim 19, wherein the conditions for controlling the vehicle traffic flow through the local traffic intersection comprise the traffic flow speed being less than a predefined percentage of the predefined speed limit, and the traffic flow speed being greater than zero.

24. The non-transitory computer readable storage medium of claim 19, wherein the eighth computer program code further comprises a thirteenth computer program code for assigning a one-time priority pass to classified vehicles to allow the classified vehicles to pass through the local traffic intersection before resuming normal operations.

* * * * *